US011043204B2

(12) United States Patent
Dukhovny et al.

(10) Patent No.: US 11,043,204 B2
(45) Date of Patent: Jun. 22, 2021

(54) ADAPTABLE AUDIO NOTIFICATIONS

(71) Applicant: ServiceNow, Inc., Santa Clara, CA (US)

(72) Inventors: Vadim Dukhovny, Petah-Tikva (IL); Alon Mansour, Ramat Gan (IL)

(73) Assignee: ServiceNow, Inc., Santa Clara, CA (US)

( * ) Notice: Subject to any disclaimer, the term of this patent is extended or adjusted under 35 U.S.C. 154(b) by 276 days.

(21) Appl. No.: 16/356,267

(22) Filed: Mar. 18, 2019

(65) Prior Publication Data

US 2020/0302910 A1 Sep. 24, 2020

(51) Int. Cl.

| | |
|---|---|
| ***G10L 13/00*** | (2006.01) |
| ***G10L 13/08*** | (2013.01) |
| ***G10L 13/033*** | (2013.01) |
| ***G10L 13/047*** | (2013.01) |

(52) U.S. Cl.

CPC ..... *G10L 13/033* (2013.01); *G10L 13/00* (2013.01); *G10L 13/047* (2013.01)

(58) Field of Classification Search

CPC ..... G10L 15/22; G10L 15/26; G10L 13/00; G10L 13/033; G10L 13/047; G10L 15/07; G10L 13/04; G10L 13/10

See application file for complete search history.

(56) References Cited

U.S. PATENT DOCUMENTS 5,609,122 A 3/1997 Jimmie
6,055,505 A * 4/2000 Elston ..... G06Q 30/0613 705/26.41
6,542,868 B1 * 4/2003 Badt ..... G10L 13/00 704/270
7,020,706 B2 3/2006 Cates
7,028,301 B2 4/2006 Ding
7,062,683 B2 6/2006 Warpenburg
(Continued)

OTHER PUBLICATIONS

Google Cloud Text-To-Speech, https://cloud.google.com/text-to-speech/ (downloaded from public Internet site Feb. 28, 2019).
(Continued)

*Primary Examiner* — Olujimi A Adesanya
(74) *Attorney, Agent, or Firm* — Fletcher Yoder PC

(57) ABSTRACT

A system and method are disclosed for adapting audio notifications associated with events in a managed network. The system may include a database for storing speech-characteristics parameters for mapping event characteristics to speech characteristics. The server device may receive a message indicating occurrence of a network event. The message may be processed to designate a particular user for notification of the event, and to determine a text message associated with the event, as well as specific event characteristics of the event. Specific speech characteristics for an audio recording of synthesized speech of the text message may be determined by mapping the specific event characteristics to user-specific parameters of the particular user. The audio recording of the synthesized speech may be generated according to the specific speech characteristics using a text-to-speech engine, and then transmitted to a client device of the particular user for playout according to the specific speech characteristics.

20 Claims, 11 Drawing Sheets

(56) References Cited

U.S. PATENT DOCUMENTS

| | | | | |
|---|---|---|---|---|
| 7,131,037 | B1 | 10/2006 | LeFaive | |
| 7,170,864 | B2 | 1/2007 | Matharu | |
| 7,350,209 | B2 | 3/2008 | Shum | |
| 7,610,512 | B2 | 10/2009 | Gerber | |
| 7,617,073 | B2 | 11/2009 | Trinon | |
| 7,689,628 | B2 | 3/2010 | Garg | |
| 7,716,353 | B2 | 5/2010 | Golovinsky | |
| 7,769,718 | B2 | 8/2010 | Murley | |
| 7,783,744 | B2 | 8/2010 | Garg | |
| 7,890,802 | B2 | 2/2011 | Gerber | |
| 7,925,981 | B2 | 4/2011 | Pourheidari | |
| 7,930,396 | B2 | 4/2011 | Trinon | |
| 7,945,860 | B2 | 5/2011 | Vambenepe | |
| 7,966,398 | B2 | 6/2011 | Wiles | |
| 8,051,164 | B2 | 11/2011 | Peuter | |
| 8,224,683 | B2 | 7/2012 | Manos | |
| 8,266,096 | B2 | 9/2012 | Navarrete | |
| 8,402,127 | B2 | 3/2013 | Solin | |
| 8,457,928 | B2 | 6/2013 | Dang | |
| 8,478,569 | B2 | 7/2013 | Scarpelli | |
| 8,612,408 | B2 | 12/2013 | Trinon | |
| 8,674,992 | B2 | 3/2014 | Poston | |
| 8,689,241 | B2 | 4/2014 | Naik | |
| 8,743,121 | B2 | 6/2014 | De Peuter | |
| 8,832,652 | B2 | 9/2014 | Mueller | |
| 8,887,133 | B2 | 11/2014 | Behnia | |
| 9,098,322 | B2 | 8/2015 | Apte | |
| 9,239,857 | B2 | 1/2016 | Trinon | |
| 9,317,327 | B2 | 4/2016 | Apte | |
| 9,363,252 | B2 | 6/2016 | Mueller | |
| 9,535,737 | B2 | 1/2017 | Joy | |
| 9,609,622 | B2 * | 3/2017 | Kaura | H04W 68/005 |
| 9,645,833 | B2 | 5/2017 | Mueller | |
| 9,654,473 | B2 | 5/2017 | Miller | |
| 9,766,935 | B2 | 9/2017 | Kelkar | |
| 9,792,387 | B2 | 10/2017 | George | |
| 9,805,211 | B2 | 10/2017 | Kelkar | |
| 10,819,560 | B2 * | 10/2020 | Makovsky | G06Q 10/103 |
| 2002/0055843 | A1 * | 5/2002 | Sakai | G10L 13/00 704/258 |
| 2005/0055648 | A1 * | 3/2005 | Dong | G10L 13/00 704/270 |
| 2013/0077772 | A1 * | 3/2013 | Lichorowic | H04M 1/271 379/88.02 |
| 2013/0106613 | A1 * | 5/2013 | Lee | H04L 51/14 340/691.3 |
| 2013/0152002 | A1 * | 6/2013 | Menczel | G06F 3/038 715/765 |
| 2014/0074483 | A1 * | 3/2014 | van Os | G06F 3/167 704/275 |
| 2017/0077885 | A1 * | 3/2017 | Grenn | G08B 3/10 |
| 2017/0171121 | A1 * | 6/2017 | Zhang | G06F 40/20 |
| 2017/0255345 | A1 * | 9/2017 | Veeramani | G06F 3/0481 |
| 2018/0204154 | A1 * | 7/2018 | Howie | H04L 41/16 |
| 2020/0051546 | A1 * | 2/2020 | Iwase | G10L 25/51 |

OTHER PUBLICATIONS

Amazon Polly, https://aws.amazon.com/polly/ (downloaded from public Internet site Feb. 28, 2019).

Web Accessibility Initiative Guidelines Overview, https://www.w3.org/WAI/standards-guidelines/wcag/ (downloaded from public Internet site Feb. 28, 2019).

* cited by examiner

900

| User | Priority<br>Pitch: [min, max]<br>Tone: [min, max] | Severity<br>Volume: [min, max]<br>Speed: [min, max] | Permissions<br>\| D \| C \| S \| H \| L \| V \| N \| | Device/Environment<br>\| D \| C \| S \| H \| L \| V \| N \| |
|---|---|---|---|---|
| Dean A | 20, 80<br>20, 100 | 25, 75<br>30, 70 | \| 1 \| 1 \| 1 \| 1 \| 0 \| 1 \| 1 \| | \| p \| s \| v \| v \| t \| v \| t \| |
| Mary L | 0, 100<br>0, 100 | 40, 80<br>35, 80 | \| 1 \| 1 \| 0 \| 1 \| 0 \| 0 \| 0 \| | \| p \| p \| v \| v \| s \| v \| v \| |
| • • • | • • • | • • • | • • • | • • • |
| Alice R | 25, 90<br>15, 85 | 26, 88<br>33, 87 | \| 1 \| 1 \| 1 \| 1 \| 1 \| 0 \| 0 \| | \| v \| v \| v \| v \| v \| v \| v \| |

902 904 906 908

FIG. 9

ADAPTABLE AUDIO NOTIFICATIONS

BACKGROUND

Managed networks may include various types of computer networks that can be remotely administered. This management may involve one or more computing devices disposed within a remote network management platform collecting information about the configuration and operational states of software applications executing on behalf on the managed network, and then presenting representations of this information by way of one or more user interfaces. The user interfaces may be, for instance, web-based user interfaces. In some instances, remote management of networks may be provided by a third party, such as a service provider or vendor.

Network management, including remote network management, may involve information technology (IT) personnel responsible for fielding problem reports relating to network operations, and undertaking actions to resolve reported problems. Such personnel may at times be alerted to problems or issues by way of notifications sent to computing and/or communication devices associated with the personnel. Notifications may initiate further actions by IT personnel to resolve reported network problems and/or issues, or may provide status of ongoing efforts.

A managed network itself may also support the mission and operations of an organization or enterprise, and the mission and operations may similarly involve customer support personnel responsible for fielding problem reports relating to organization/enterprise operations, and undertaking actions to resolve reported problems. As with network management, customer support personnel may similarly be alerted to problems or issues by way of notifications sent to computing and/or communication devices associated with the personnel. Notifications may thus serve a similar role in organization/enterprise operations.

SUMMARY

It is now common for enterprise networks to include tens of thousands of devices across dozens of networks, supporting thousands of users. Enterprise networks may be deployed as remotely managed networks, in which many aspects of the actual underlying network architecture, as well as network operations, are managed offsite by a third party. Management of both networks, and enterprises that are supported by the networks, may involve various types and/or teams of support personnel to handle problems reported that may arise, and to undertake actions to get the problems resolved.

In the context of network management, as well as enterprise operations that are supported by networks, occurrences of problems, issues, status changes, and the like, that may arise are customarily and broadly referred to as "events." An event may thus be associated with, and/or causally related to, the occurrence of a problem, issue, or status change, for example. There could also be other non-critical or less-critical causes for events. The occurrence of an event may serve as a trigger or initiator for one or more actions or procedures aimed at addressing or resolving the condition that caused the event, including creation and delivery of an event notification to one or more support personnel.

Thus, support personnel may learn of new problems and/or be updated about the status of ongoing issues through event notifications and alerts sent to their client computing and/or communication devices. Non-limiting examples of such client devices may include laptop and desktop computers, smartphones, and other personal digital assistant (PDA) devices.

While it may be typical or common for event notifications to be presented visually, such as in display devices or display components of client devices, the inventors have recognized that audio notifications may provide an additional mode of content delivery, and may in fact be a preferred mode for some support personnel, at least in some situations. For example some support personnel may have personal preferences for receiving audio notifications in addition to, or instead of, visual notifications. As another example, some personnel may wear headphones with a smartphone while commuting to or from work, and may be only or mostly available by audio alert. These are just a few possible examples of why audio alerts may be useful or even preferred, at least at certain times and/or under certain circumstances.

The inventors have further recognized that one or more specific characteristics of events, including such non-limiting examples as event type, event priority, or event severity, may be used to compose appropriate text messages associated with events, or to identify appropriate pre-existing (e.g., stored) text messages associated with known types or classes of events. Spoken audio versions of the text messages may then be generated using a text-to-speech (TTS) synthesizer. In an example embodiment, one or another of existing TTS "engines" may be used to generate an audio recording of synthesized speech corresponding to a text message relating to the occurrence of an event. In practice, a TTS engine may be implemented and/or available as a software program or application. While the availability of TTS engines may provide a necessary or useful tool for audio versions of event notifications, the inventors have also recognized, in particular, that text-to-speech conversion of event notification messages alone may fall short of the desired benefits of spoken versions of event notifications.

More specifically, visual alerts for events may typically be displayed with or include visual cues related to, or associated with, specific characteristics of the events. Visual cues associated with specific event characteristics may include color, size and/or style of fonts, and other graphical characteristics and/or features. The inventors have recognized that playout by a client device of audio notifications of events should correspondingly have various types of audio cues similarly mapped from specific event characteristics. Non-limiting examples of audio cues may include speech volume, speech tone, speech pitch, and speech speed. By devising techniques for mapping specific event characteristics to audio properties, such as speech characteristics of spoken messages, example embodiments may provide for adapting event notifications to fully dimensional audio messages.

Example embodiments disclosed herein are directed to systems and methods for mapping specific event characteristics to audio properties, such as speech characteristics of spoken messages, and thereby providing for adapting event notifications to fully dimensional audio messages. Example embodiments are further directed to techniques for including real-time factors in determining appropriated speech and/or audio characteristics in spoken messages.

Accordingly, a first example embodiment may involve a system for adapting audio notifications associated with events in a managed network of a computational instance of a remote network management platform, wherein the system is disposed within the computational instance, the system comprising: a database configured for storing speech-characteristics parameters for mapping event characteristics to speech characteristics, wherein the database comprises records, and wherein each record is associated with a respective user, and includes user-specific parameters for mapping event characteristics to speech characteristics, the user-specific parameters being customizable according to the respective user, and the speech characteristics including at least one of volume, pitch, tone, or speed; and one or more server devices disposed within the remote network management platform, wherein the one or more server devices are configured to: receive, from a computing device communicatively connected with the managed network, a message indicating an occurrence of a network event; process the message to designate a particular user for notification of the network event, and to determine (i) a text message associated with the network event, and (ii) specific event characteristics of the network event, wherein the specific event characteristics comprise event type, event severity, and event priority; determine specific speech characteristics for an audio recording of synthesized speech of the text message by at least mapping the specific event characteristics to the user specific parameters of the particular user; generate the audio recording of synthesized speech of the text message according to the determined specific speech characteristics using a text-to-speech engine; and transmit the audio recording to a client device associated with the particular user for playout by the client device according to the specific speech characteristics.

In a second example embodiment may involve a method for adapting audio notifications associated with events in a managed network of a computational instance of a remote network management platform, wherein a database disposed within the computational instance is configured for storing speech-characteristics parameters for mapping event characteristics to speech characteristics, wherein the database comprises records, and wherein each record is associated with a respective user, and includes user-specific parameters for mapping event characteristics to speech characteristics, the user-specific parameters being customizable according to the respective user, and the speech characteristics including at least one of volume, pitch, tone, or speed, and wherein the method comprises: at a server device disposed within the remote network management platform, receiving, from a computing device communicatively connected with the managed network, a message indicating an occurrence of a network event; at the server device, processing the message to designate a particular user for notification of the network event, and to determine (i) a text message associated with the network event, and (ii) specific event characteristics of the network event, wherein the specific event characteristics comprise event type, event severity, and event priority; determining specific speech characteristics for an audio recording of synthesized speech of the text message by at least mapping the specific event characteristics to the user specific parameters of the particular user; generating the audio recording of synthesized speech of the text message according to the determined specific speech characteristics using a text-to-speech engine; and transmitting the audio recording to a client device associated with the particular user for playout by the client device according to the specific speech characteristics.

In a third example embodiment may involve a non-transitory computer readable medium having instructions stored thereon for adapting audio notifications associated with events in a managed network of a computational instance of a remote network management platform, wherein a database disposed within the computational instance is configured for storing speech-characteristics parameters for mapping event characteristics to speech characteristics, wherein the database comprises records, and wherein each record is associated with a respective user, and includes user-specific parameters for mapping event characteristics to speech characteristics, the user-specific parameters being customizable according to the respective user, and the speech characteristics including at least one of volume, pitch, tone, or speed, and wherein the instructions, when executed by one or more processors of a server device disposed within the remote network management platform, cause the server device to carry out operations including: receiving, from a computing device communicatively connected with the managed network, a message indicating an occurrence of a network event; processing the message to designate a particular user for notification of the network event, and to determine (i) a text message associated with the network event, and (ii) specific event characteristics of the network event, wherein the specific event characteristics comprise event type, event severity, and event priority; determining specific speech characteristics for an audio recording of synthesized speech of the text message by at least mapping the specific event characteristics to the user specific parameters of the particular user; generating the audio recording of synthesized speech of the text message according to the determined specific speech characteristics using a text-to-speech engine; and transmitting the audio recording to a client device associated with the particular user for playout by the client device according to the specific speech characteristics.

In a fourth example embodiment, a system may include various means for carrying out each of the operations of the third example embodiment.

These as well as other embodiments, aspects, advantages, and alternatives will become apparent to those of ordinary skill in the art by reading the following detailed description, with reference where appropriate to the accompanying drawings. Further, this summary and other descriptions and figures provided herein are intended to illustrate embodiments by way of example only and, as such, that numerous variations are possible. For instance, structural elements and process steps can be rearranged, combined, distributed, eliminated, or otherwise changed, while remaining within the scope of the embodiments as claimed.

BRIEF DESCRIPTION OF THE DRAWINGS

FIG. 9 illustrates an example record format for user parameters in a database of example system for adapting audio notifications in accordance with example embodiments.

DETAILED DESCRIPTION

Figure 1:
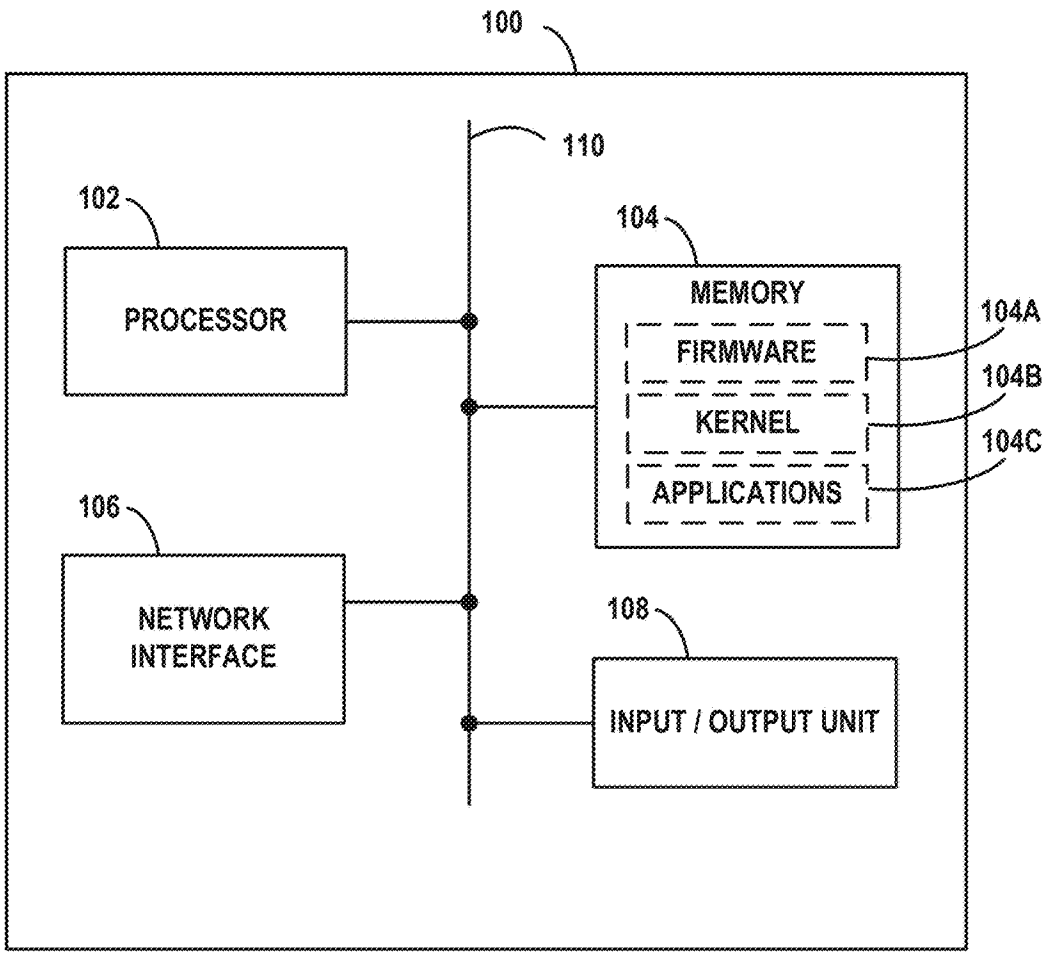
FIG. 1 illustrates a schematic drawing of a computing device, in accordance with example embodiments.

Example methods, devices, and systems are described herein. It should be understood that the words "example" and "exemplary" are used herein to mean "serving as an example, instance, or illustration." Any embodiment or feature described herein as being an "example" or "exemplary" is not necessarily to be construed as preferred or advantageous over other embodiments or features unless stated as such. Thus, other embodiments can be utilized and other changes can be made without departing from the scope of the subject matter presented herein.

Accordingly, the example embodiments described herein are not meant to be limiting. It will be readily understood that the aspects of the present disclosure, as generally described herein, and illustrated in the figures, can be arranged, substituted, combined, separated, and designed in a wide variety of different configurations. For example, the separation of features into "client" and "server" components may occur in a number of ways.

Further, unless context suggests otherwise, the features illustrated in each of the figures may be used in combination with one another. Thus, the figures should be generally viewed as component aspects of one or more overall embodiments, with the understanding that not all illustrated features are necessary for each embodiment.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

I. Introduction

A large enterprise is a complex entity with many interrelated operations. Some of these are found across the enterprise, such as human resources (HR), supply chain, information technology (IT), and finance. However, each enterprise also has its own unique operations that provide essential capabilities and/or create competitive advantages.

To support widely-implemented operations, enterprises typically use off-the-shelf software applications, such as customer relationship management (CRM) and human capital management (HCM) packages. However, they may also need custom software applications to meet their own unique requirements. A large enterprise often has dozens or hundreds of these custom software applications. Nonetheless, the advantages provided by the embodiments herein are not limited to large enterprises and may be applicable to an enterprise, or any other type of organization, of any size.

Many such software applications are developed by individual departments within the enterprise. These range from simple spreadsheets to custom-built software tools and databases. But the proliferation of siloed custom software applications has numerous disadvantages. It negatively impacts an enterprise's ability to run and grow its operations, innovate, and meet regulatory requirements. The enterprise may find it difficult to integrate, streamline and enhance its operations due to lack of a single system that unifies its subsystems and data.

To efficiently create custom applications, enterprises would benefit from a remotely-hosted application platform that eliminates unnecessary development complexity. The goal of such a platform would be to reduce time-consuming, repetitive application development tasks so that software engineers and individuals in other roles can focus on developing unique, high-value features.

In order to achieve this goal, the concept of Application Platform as a Service (aPaaS) is introduced, to intelligently automate workflows throughout the enterprise. An aPaaS system is hosted remotely from the enterprise, but may access data, applications, and services within the enterprise by way of secure connections. Such an aPaaS system may have a number of advantageous capabilities and characteristics. These advantages and characteristics may be able to improve the enterprise's operations and workflow for IT, HR, CRM, customer service, application development, and security.

The aPaaS system may support development and execution of model-view-controller (MVC) applications. MVC applications divide their functionality into three interconnected parts (model, view, and controller) in order to isolate representations of information from the manner in which the information is presented to the user, thereby allowing for efficient code reuse and parallel development. These applications may be web-based, and offer create, read, update, delete (CRUD) capabilities. This allows new applications to be built on a common application infrastructure.

The aPaaS system may support standardized application components, such as a standardized set of widgets for graphical user interface (GUI) development. In this way, applications built using the aPaaS system have a common look and feel. Other software components and modules may be standardized as well. In some cases, this look and feel can be branded or skinned with an enterprise's custom logos and/or color schemes.

The aPaaS system may support the ability to configure the behavior of applications using metadata. This allows application behaviors to be rapidly adapted to meet specific needs. Such an approach reduces development time and increases flexibility. Further, the aPaaS system may support GUI tools that facilitate metadata creation and management, thus reducing errors in the metadata.

The aPaaS system may support clearly-defined interfaces between applications, so that software developers can avoid unwanted inter-application dependencies. Thus, the aPaaS system may implement a service layer in which persistent state information and other data is stored.

The aPaaS system may support a rich set of integration features so that the applications thereon can interact with legacy applications and third-party applications. For instance, the aPaaS system may support a custom employee-onboarding system that integrates with legacy HR, IT, and accounting systems.

The aPaaS system may support enterprise-grade security. Furthermore, since the aPaaS system may be remotely hosted, it should also utilize security procedures when it interacts with systems in the enterprise or third-party networks and services hosted outside of the enterprise. For example, the aPaaS system may be configured to share data amongst the enterprise and other parties to detect and identify common security threats.

Other features, functionality, and advantages of an aPaaS system may exist. This description is for purpose of example and is not intended to be limiting.

As an example of the aPaaS development process, a software developer may be tasked to create a new application using the aPaaS system. First, the developer may define the data model, which specifies the types of data that the application uses and the relationships therebetween. Then, via a GUI of the aPaaS system, the developer enters (e.g., uploads) the data model. The aPaaS system automatically creates all of the corresponding database tables, fields, and relationships, which can then be accessed via an object-oriented services layer.

In addition, the aPaaS system can also build a fully-functional MVC application with client-side interfaces and server-side CRUD logic. This generated application may serve as the basis of further development for the user. Advantageously, the developer does not have to spend a large amount of time on basic application functionality. Further, since the application may be web-based, it can be accessed from any Internet-enabled client device. Alternatively or additionally, a local copy of the application may be able to be accessed, for instance, when Internet service is not available.

The aPaaS system may also support a rich set of predefined functionality that can be added to applications. These features include support for searching, email, templating, workflow design, reporting, analytics, social media, scripting, mobile-friendly output, and customized GUIs.

The following embodiments describe architectural and functional aspects of example aPaaS systems, as well as the features and advantages thereof.

II. Example Computing Devices and Cloud-Based Computing Environments

FIG. 1 is a simplified block diagram exemplifying a computing device 100, illustrating some of the components that could be included in a computing device arranged to operate in accordance with the embodiments herein. Computing device 100 could be a client device (e.g., a device actively operated by a user), a server device (e.g., a device that provides computational services to client devices), or some other type of computational platform. Some server devices may operate as client devices from time to time in order to perform particular operations, and some client devices may incorporate server features.

In this example, computing device 100 includes processor 102, memory 104, network interface 106, and an input/output unit 108, all of which may be coupled by a system bus 110 or a similar mechanism. In some embodiments, computing device 100 may include other components and/or peripheral devices (e.g., detachable storage, printers, and so on).

Processor 102 may be one or more of any type of computer processing element, such as a central processing unit (CPU), a co-processor (e.g., a mathematics, graphics, or encryption co-processor), a digital signal processor (DSP), a network processor, and/or a form of integrated circuit or controller that performs processor operations. In some cases, processor 102 may be one or more single-core processors. In other cases, processor 102 may be one or more multi-core processors with multiple independent processing units. Processor 102 may also include register memory for temporarily storing instructions being executed and related data, as well as cache memory for temporarily storing recently-used instructions and data.

Memory 104 may be any form of computer-usable memory, including but not limited to random access memory (RAM), read-only memory (ROM), and non-volatile memory (e.g., flash memory, hard disk drives, solid state drives, compact discs (CDs), digital video discs (DVDs), and/or tape storage). Thus, memory 104 represents both main memory units, as well as long-term storage. Other types of memory may include biological memory.

Memory 104 may store program instructions and/or data on which program instructions may operate. By way of example, memory 104 may store these program instructions on a non-transitory, computer-readable medium, such that the instructions are executable by processor 102 to carry out any of the methods, processes, or operations disclosed in this specification or the accompanying drawings.

As shown in FIG. 1, memory 104 may include firmware 104A, kernel 104B, and/or applications 104C. Firmware 104A may be program code used to boot or otherwise initiate some or all of computing device 100. Kernel 104B may be an operating system, including modules for memory management, scheduling and management of processes, input/output, and communication. Kernel 104B may also include device drivers that allow the operating system to communicate with the hardware modules (e.g., memory units, networking interfaces, ports, and busses), of computing device 100. Applications 104C may be one or more user-space software programs, such as web browsers or email clients, as well as any software libraries used by these programs. Memory 104 may also store data used by these and other programs and applications.

Network interface 106 may take the form of one or more wireline interfaces, such as Ethernet (e.g., Fast Ethernet, Gigabit Ethernet, and so on). Network interface 106 may also support communication over one or more non-Ethernet media, such as coaxial cables or power lines, or over wide-area media, such as Synchronous Optical Networking (SONET) or digital subscriber line (DSL) technologies. Network interface 106 may additionally take the form of one or more wireless interfaces, such as IEEE 802.11 (Wifi), BLUETOOTH®, global positioning system (GPS), or a wide-area wireless interface. However, other forms of physical layer interfaces and other types of standard or proprietary communication protocols may be used over network interface 106. Furthermore, network interface 106 may comprise multiple physical interfaces. For instance, some embodiments of computing device 100 may include Ethernet, BLUETOOTH®, and Wifi interfaces.

Input/output unit 108 may facilitate user and peripheral device interaction with computing device 100. Input/output unit 108 may include one or more types of input devices, such as a keyboard, a mouse, a touch screen, and so on. Similarly, input/output unit 108 may include one or more types of output devices, such as a screen, monitor, printer, and/or one or more light emitting diodes (LEDs). Additionally or alternatively, computing device 100 may communicate with other devices using a universal serial bus (USB) or high-definition multimedia interface (HDMI) port interface, for example.

In some embodiments, one or more computing devices like computing device 100 may be deployed to support an aPaaS architecture. The exact physical location, connectivity, and configuration of these computing devices may be unknown and/or unimportant to client devices. Accordingly, the computing devices may be referred to as "cloud-based" devices that may be housed at various remote data center locations.

Figure 2:
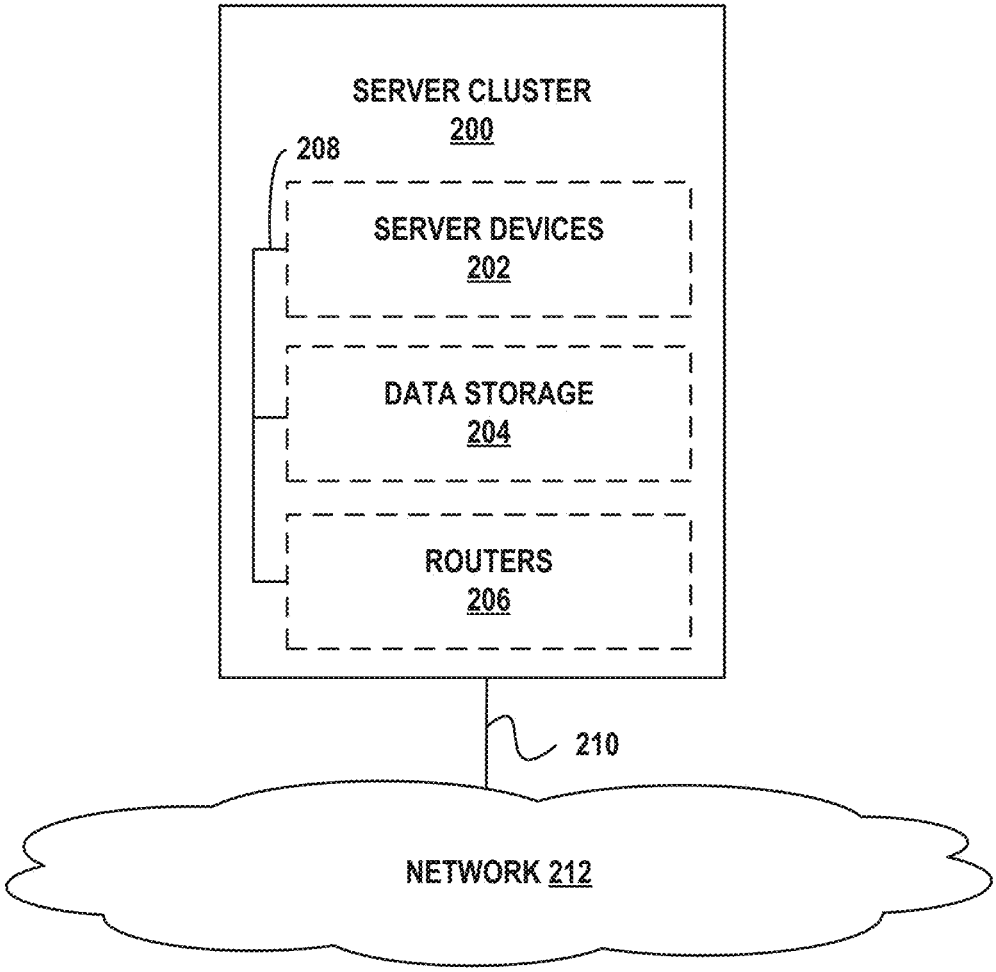
FIG. 2 illustrates a schematic drawing of a server device cluster, in accordance with example embodiments.

FIG. 2 depicts a cloud-based server cluster 200 in accordance with example embodiments. In FIG. 2, operations of a computing device (e.g., computing device 100) may be distributed between server devices 202, data storage 204, and routers 206, all of which may be connected by local cluster network 208. The number of server devices 202, data storages 204, and routers 206 in server cluster 200 may depend on the computing task(s) and/or applications assigned to server cluster 200.

For example, server devices 202 can be configured to perform various computing tasks of computing device 100. Thus, computing tasks can be distributed among one or more of server devices 202. To the extent that these computing tasks can be performed in parallel, such a distribution of tasks may reduce the total time to complete these tasks and return a result. For purpose of simplicity, both server cluster 200 and individual server devices 202 may be referred to as a "server device." This nomenclature should be understood to imply that one or more distinct server devices, data storage devices, and cluster routers may be involved in server device operations.

Data storage 204 may be data storage arrays that include drive array controllers configured to manage read and write access to groups of hard disk drives and/or solid state drives. The drive array controllers, alone or in conjunction with server devices 202, may also be configured to manage backup or redundant copies of the data stored in data storage 204 to protect against drive failures or other types of failures that prevent one or more of server devices 202 from accessing units of data storage 204. Other types of memory aside from drives may be used.

Routers 206 may include networking equipment configured to provide internal and external communications for server cluster 200. For example, routers 206 may include one or more packet-switching and/or routing devices (including switches and/or gateways) configured to provide (i) network communications between server devices 202 and data storage 204 via local cluster network 208, and/or (ii) network communications between the server cluster 200 and other devices via communication link 210 to network 212.

Additionally, the configuration of routers 206 can be based at least in part on the data communication requirements of server devices 202 and data storage 204, the latency and throughput of the local cluster network 208, the latency, throughput, and cost of communication link 210, and/or other factors that may contribute to the cost, speed, fault-tolerance, resiliency, efficiency and/or other design goals of the system architecture.

As a possible example, data storage 204 may include any form of database, such as a structured query language (SQL) database. Various types of data structures may store the information in such a database, including but not limited to tables, arrays, lists, trees, and tuples. Furthermore, any databases in data storage 204 may be monolithic or distributed across multiple physical devices.

Server devices 202 may be configured to transmit data to and receive data from data storage 204. This transmission and retrieval may take the form of SQL queries or other types of database queries, and the output of such queries, respectively. Additional text, images, video, and/or audio may be included as well. Furthermore, server devices 202 may organize the received data into web page representations. Such a representation may take the form of a markup language, such as the hypertext markup language (HTML), the extensible markup language (XML), or some other standardized or proprietary format. Moreover, server devices 202 may have the capability of executing various types of computerized scripting languages, such as but not limited to Perl, Python, PHP Hypertext Preprocessor (PHP), Active Server Pages (ASP), JavaScript, and so on. Computer program code written in these languages may facilitate the providing of web pages to client devices, as well as client device interaction with the web pages.

III. Example Remote Network Management Architecture

Figure 3:
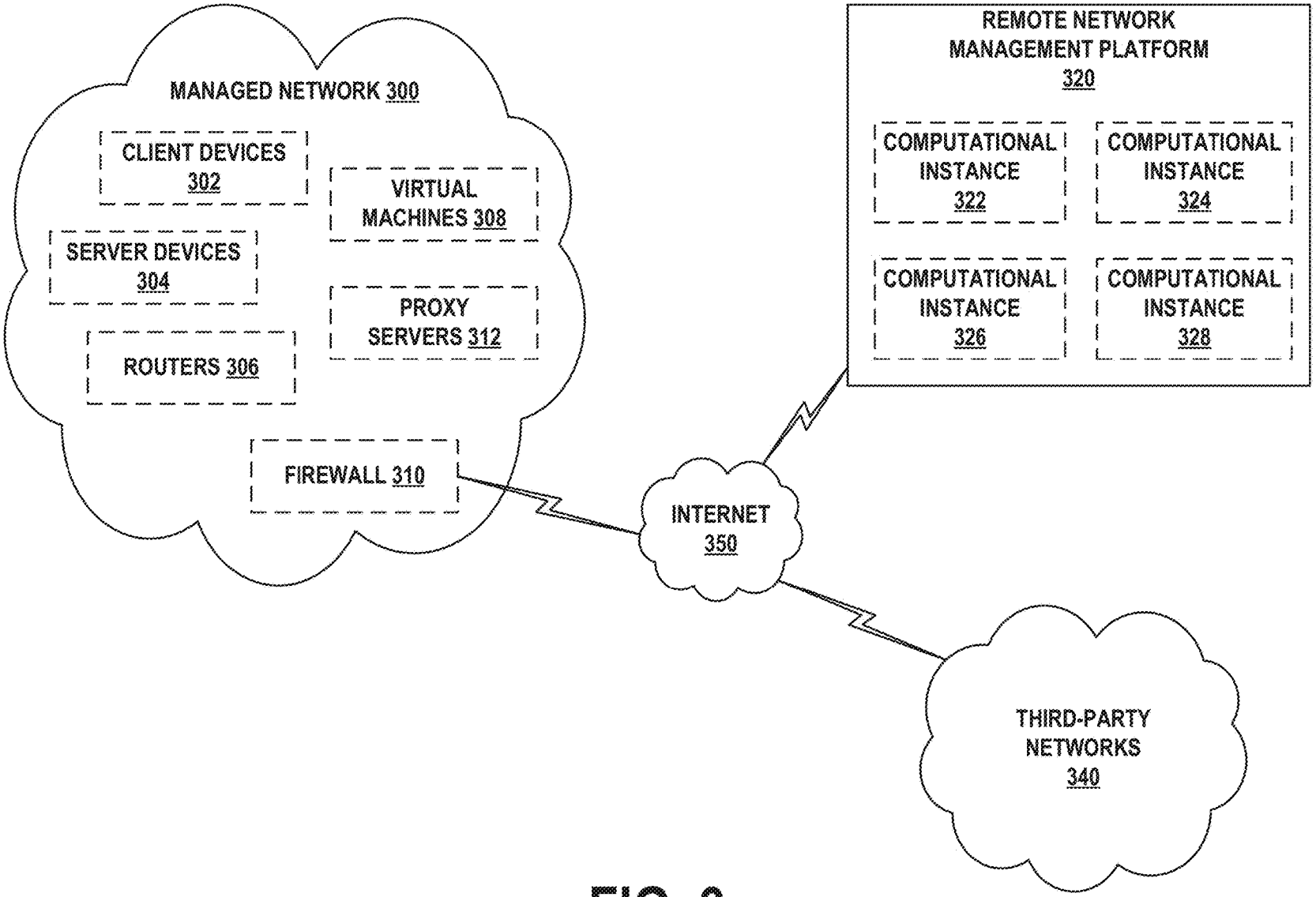
FIG. 3 depicts a remote network management architecture, in accordance with example embodiments.

FIG. 3 depicts a remote network management architecture, in accordance with example embodiments. This architecture includes three main components, managed network 300, remote network management platform 320, and third-party networks 340, all connected by way of Internet 350.

Managed network 300 may be, for example, an enterprise network used by an entity for computing and communications tasks, as well as storage of data. Thus, managed network 300 may include client devices 302, server devices 304, routers 306, virtual machines 308, firewall 310, and/or proxy servers 312. Client devices 302 may be embodied by computing device 100, server devices 304 may be embodied by computing device 100 or server cluster 200, and routers 306 may be any type of router, switch, or gateway.

Virtual machines 308 may be embodied by one or more of computing device 100 or server cluster 200. In general, a virtual machine is an emulation of a computing system, and mimics the functionality (e.g., processor, memory, and communication resources) of a physical computer. One physical computing system, such as server cluster 200, may support up to thousands of individual virtual machines. In some embodiments, virtual machines 308 may be managed by a centralized server device or application that facilitates allocation of physical computing resources to individual virtual machines, as well as performance and error reporting. Enterprises often employ virtual machines in order to allocate computing resources in an efficient, as needed fashion. Providers of virtualized computing systems include VMWARE® and MICROSOFT®.

Firewall 310 may be one or more specialized routers or server devices that protect managed network 300 from unauthorized attempts to access the devices, applications, and services therein, while allowing authorized communication that is initiated from managed network 300. Firewall 310 may also provide intrusion detection, web filtering, virus scanning, application-layer gateways, and other applications or services. In some embodiments not shown in FIG. 3, managed network 300 may include one or more virtual private network (VPN) gateways with which it communicates with remote network management platform 320 (see below).

Managed network 300 may also include one or more proxy servers 312. An embodiment of proxy servers 312 may be a server device that facilitates communication and movement of data between managed network 300, remote network management platform 320, and third-party networks 340. In particular, proxy servers 312 may be able to establish and maintain secure communication sessions with one or more computational instances of remote network management platform 320. By way of such a session, remote network management platform 320 may be able to discover and manage aspects of the architecture and configuration of managed network 300 and its components. Possibly with the assistance of proxy servers 312, remote network management platform 320 may also be able to discover and manage aspects of third-party networks 340 that are used by managed network 300.

Firewalls, such as firewall 310, typically deny all communication sessions that are incoming by way of Internet 350, unless such a session was ultimately initiated from behind the firewall (i.e., from a device on managed network 300) or the firewall has been explicitly configured to support the session. By placing proxy servers 312 behind firewall 310 (e.g., within managed network 300 and protected by firewall 310), proxy servers 312 may be able to initiate these communication sessions through firewall 310. Thus, firewall 310 might not have to be specifically configured to support incoming sessions from remote network management platform 320, thereby avoiding potential security risks to managed network 300.

In some cases, managed network 300 may consist of a few devices and a small number of networks. In other deployments, managed network 300 may span multiple physical locations and include hundreds of networks and hundreds of thousands of devices. Thus, the architecture depicted in FIG. 3 is capable of scaling up or down by orders of magnitude.

Furthermore, depending on the size, architecture, and connectivity of managed network 300, a varying number of proxy servers 312 may be deployed therein. For example, each one of proxy servers 312 may be responsible for communicating with remote network management platform 320 regarding a portion of managed network 300. Alternatively or additionally, sets of two or more proxy servers may be assigned to such a portion of managed network 300 for purposes of load balancing, redundancy, and/or high availability.

Remote network management platform 320 is a hosted environment that provides aPaaS services to users, particularly to the operators of managed network 300. These services may take the form of web-based portals, for instance. Thus, a user can securely access remote network management platform 320 from, for instance, client devices 302, or potentially from a client device outside of managed network 300. By way of the web-based portals, users may design, test, and deploy applications, generate reports, view analytics, and perform other tasks.

As shown in FIG. 3, remote network management platform 320 includes four computational instances 322, 324, 326, and 328. Each of these instances may represent one or more server devices and/or one or more databases that provide a set of web portals, services, and applications (e.g., a wholly-functioning aPaaS system) available to a particular customer. In some cases, a single customer may use multiple computational instances. For example, managed network 300 may be an enterprise customer of remote network management platform 320, and may use computational instances 322, 324, and 326. The reason for providing multiple instances to one customer is that the customer may wish to independently develop, test, and deploy its applications and services. Thus, computational instance 322 may be dedicated to application development related to managed network 300, computational instance 324 may be dedicated to testing these applications, and computational instance 326 may be dedicated to the live operation of tested applications and services. A computational instance may also be referred to as a hosted instance, a remote instance, a customer instance, or by some other designation. Any application deployed onto a computational instance may be a scoped application, in that its access to databases within the computational instance can be restricted to certain elements therein (e.g., one or more particular database tables or particular rows with one or more database tables).

For purpose of clarity, the disclosure herein refers to the physical hardware, software, and arrangement thereof as a "computational instance." Note that users may colloquially refer to the graphical user interfaces provided thereby as "instances." But unless it is defined otherwise herein, a "computational instance" is a computing system disposed within remote network management platform 320.

The multi-instance architecture of remote network management platform 320 is in contrast to conventional multi-tenant architectures, over which multi-instance architectures exhibit several advantages. In multi-tenant architectures, data from different customers (e.g., enterprises) are comingled in a single database. While these customers' data are separate from one another, the separation is enforced by the software that operates the single database. As a consequence, a security breach in this system may impact all customers' data, creating additional risk, especially for entities subject to governmental, healthcare, and/or financial regulation. Furthermore, any database operations that impact one customer will likely impact all customers sharing that database. Thus, if there is an outage due to hardware or software errors, this outage affects all such customers. Likewise, if the database is to be upgraded to meet the needs of one customer, it will be unavailable to all customers during the upgrade process. Often, such maintenance windows will be long, due to the size of the shared database.

In contrast, the multi-instance architecture provides each customer with its own database in a dedicated computing instance. This prevents comingling of customer data, and allows each instance to be independently managed. For example, when one customer's instance experiences an outage due to errors or an upgrade, other computational instances are not impacted. Maintenance down time is limited because the database only contains one customer's data. Further, the simpler design of the multi-instance architecture allows redundant copies of each customer database and instance to be deployed in a geographically diverse fashion. This facilitates high availability, where the live version of the customer's instance can be moved when faults are detected or maintenance is being performed.

In some embodiments, remote network management platform 320 may include one or more central instances, controlled by the entity that operates this platform. Like a computational instance, a central instance may include some number of physical or virtual servers and database devices. Such a central instance may serve as a repository for data that can be shared amongst at least some of the computational instances. For instance, definitions of common security threats that could occur on the computational instances, software packages that are commonly discovered on the computational instances, and/or an application store for applications that can be deployed to the computational instances may reside in a central instance. Computational instances may communicate with central instances by way of well-defined interfaces in order to obtain this data.

In order to support multiple computational instances in an efficient fashion, remote network management platform 320 may implement a plurality of these instances on a single hardware platform. For example, when the aPaaS system is implemented on a server cluster such as server cluster 200, it may operate a virtual machine that dedicates varying amounts of computational, storage, and communication resources to instances. But full virtualization of server cluster 200 might not be necessary, and other mechanisms may be used to separate instances. In some examples, each instance may have a dedicated account and one or more dedicated databases on server cluster 200. Alternatively, computational instance 322 may span multiple physical devices.

In some cases, a single server cluster of remote network management platform 320 may support multiple independent enterprises. Furthermore, as described below, remote network management platform 320 may include multiple server clusters deployed in geographically diverse data centers in order to facilitate load balancing, redundancy, and/or high availability.

Third-party networks 340 may be remote server devices (e.g., a plurality of server clusters such as server cluster 200) that can be used for outsourced computational, data storage, communication, and service hosting operations. These servers may be virtualized (i.e., the servers may be virtual machines). Examples of third-party networks 340 may include AMAZON WEB SERVICES® and MICROSOFT® Azure. Like remote network management platform 320, multiple server clusters supporting third-party networks 340 may be deployed at geographically diverse locations for purposes of load balancing, redundancy, and/or high availability.

Managed network 300 may use one or more of third-party networks 340 to deploy applications and services to its clients and customers. For instance, if managed network 300 provides online music streaming services, third-party networks 340 may store the music files and provide web interface and streaming capabilities. In this way, the enterprise of managed network 300 does not have to build and maintain its own servers for these operations.

Remote network management platform 320 may include modules that integrate with third-party networks 340 to expose virtual machines and managed services therein to managed network 300. The modules may allow users to request virtual resources and provide flexible reporting for third-party networks 340. In order to establish this functionality, a user from managed network 300 might first establish an account with third-party networks 340, and request a set of associated resources. Then, the user may enter the account information into the appropriate modules of remote network management platform 320. These modules may then automatically discover the manageable resources in the account, and also provide reports related to usage, performance, and billing.

Internet 350 may represent a portion of the global Internet. However, Internet 350 may alternatively represent a different type of network, such as a private wide-area or local-area packet-switched network.

Figure 4:
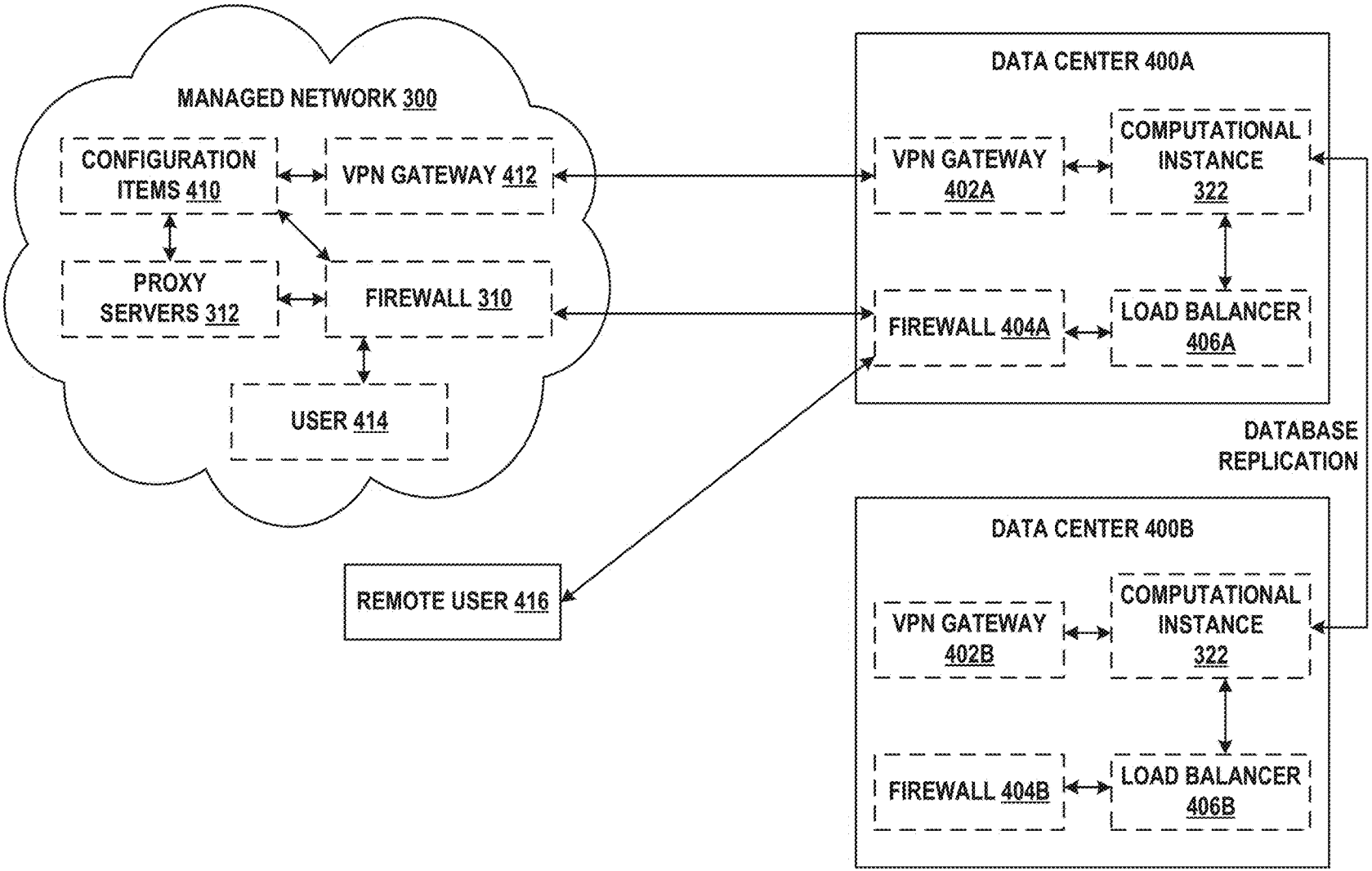
FIG. 4 depicts a communication environment involving a remote network management architecture, in accordance with example embodiments.

FIG. 4 further illustrates the communication environment between managed network 300 and computational instance 322, and introduces additional features and alternative embodiments. In FIG. 4, computational instance 322 is replicated across data centers 400A and 400B. These data centers may be geographically distant from one another, perhaps in different cities or different countries. Each data center includes support equipment that facilitates communication with managed network 300, as well as remote users.

In data center 400A, network traffic to and from external devices flows either through VPN gateway 402A or firewall 404A. VPN gateway 402A may be peered with VPN gateway 412 of managed network 300 by way of a security protocol such as Internet Protocol Security (IPSEC) or Transport Layer Security (TLS). Firewall 404A may be configured to allow access from authorized users, such as user 414 and remote user 416, and to deny access to unauthorized users. By way of firewall 404A, these users may access computational instance 322, and possibly other computational instances. Load balancer 406A may be used to distribute traffic amongst one or more physical or virtual server devices that host computational instance 322. Load balancer 406A may simplify user access by hiding the internal configuration of data center 400A, (e.g., computational instance 322) from client devices. For instance, if computational instance 322 includes multiple physical or virtual computing devices that share access to multiple databases, load balancer 406A may distribute network traffic and processing tasks across these computing devices and databases so that no one computing device or database is significantly busier than the others. In some embodiments, computational instance 322 may include VPN gateway 402A, firewall 404A, and load balancer 406A.

Data center 400B may include its own versions of the components in data center 400A. Thus, VPN gateway 402B, firewall 404B, and load balancer 406B may perform the same or similar operations as VPN gateway 402A, firewall 404A, and load balancer 406A, respectively. Further, by way of real-time or near-real-time database replication and/or other operations, computational instance 322 may exist simultaneously in data centers 400A and 400B.

Data centers 400A and 400B as shown in FIG. 4 may facilitate redundancy and high availability. In the configuration of FIG. 4, data center 400A is active and data center 400B is passive. Thus, data center 400A is serving all traffic to and from managed network 300, while the version of computational instance 322 in data center 400B is being updated in near-real-time. Other configurations, such as one in which both data centers are active, may be supported.

Should data center 400A fail in some fashion or otherwise become unavailable to users, data center 400B can take over as the active data center. For example, domain name system (DNS) servers that associate a domain name of computational instance 322 with one or more Internet Protocol (IP) addresses of data center 400A may re-associate the domain name with one or more IP addresses of data center 400B. After this re-association completes (which may take less than one second or several seconds), users may access computational instance 322 by way of data center 400B.

FIG. 4 also illustrates a possible configuration of managed network 300. As noted above, proxy servers 312 and user 414 may access computational instance 322 through firewall 310. Proxy servers 312 may also access configuration items 410. In FIG. 4, configuration items 410 may refer to any or all of client devices 302, server devices 304, routers 306, and virtual machines 308, any applications or services executing thereon, as well as relationships between devices, applications, and services. Thus, the term "configuration items" may be shorthand for any physical or virtual device, or any application or service remotely discoverable or managed by computational instance 322, or relationships between discovered devices, applications, and services. Configuration items may be represented in a configuration management database (CMDB) of computational instance 322.

As noted above, VPN gateway 412 may provide a dedicated VPN to VPN gateway 402A. Such a VPN may be helpful when there is a significant amount of traffic between managed network 300 and computational instance 322, or security policies otherwise suggest or require use of a VPN between these sites. In some embodiments, any device in managed network 300 and/or computational instance 322 that directly communicates via the VPN is assigned a public IP address. Other devices in managed network 300 and/or computational instance 322 may be assigned private IP addresses (e.g., IP addresses selected from the 10.0.0.0-10.255.255.255 or 192.168.0.0-192.168.255.255 ranges, represented in shorthand as subnets 10.0.0.0/8 and 192.168.0.0/16, respectively).

IV. Example Device, Application, and Service Discovery

In order for remote network management platform 320 to administer the devices, applications, and services of managed network 300, remote network management platform 320 may first determine what devices are present in managed network 300, the configurations and operational statuses of these devices, and the applications and services provided by the devices, and well as the relationships between discovered devices, applications, and services. As noted above, each device, application, service, and relationship may be referred to as a configuration item. The process of defining configuration items within managed network 300 is referred to as discovery, and may be facilitated at least in part by proxy servers 312.

For purpose of the embodiments herein, an "application" may refer to one or more processes, threads, programs, client modules, server modules, or any other software that executes on a device or group of devices. A "service" may refer to a high-level capability provided by multiple applications executing on one or more devices working in conjunction with one another. For example, a high-level web service may involve multiple web application server threads executing on one device and accessing information from a database application that executes on another device.

Figure 5A:
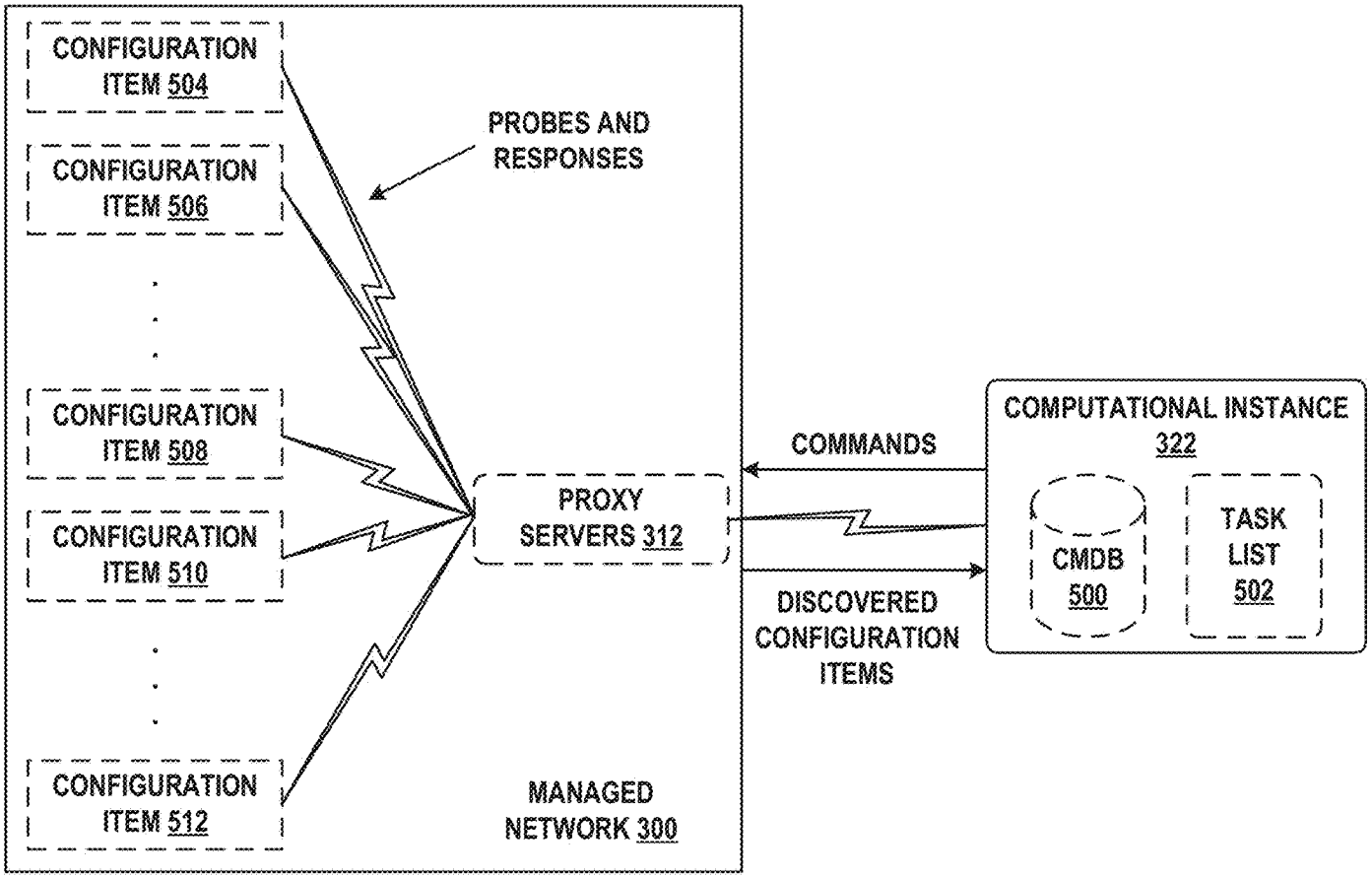
FIG. 5A depicts another communication environment involving a remote network management architecture, in accordance with example embodiments.

FIG. 5A provides a logical depiction of how configuration items can be discovered, as well as how information related to discovered configuration items can be stored. For sake of simplicity, remote network management platform 320, third-party networks 340, and Internet 350 are not shown.

In FIG. 5A, CMDB 500 and task list 502 are stored within computational instance 322. Computational instance 322 may transmit discovery commands to proxy servers 312. In response, proxy servers 312 may transmit probes to various devices, applications, and services in managed network 300. These devices, applications, and services may transmit responses to proxy servers 312, and proxy servers 312 may then provide information regarding discovered configuration items to CMDB 500 for storage therein. Configuration items stored in CMDB 500 represent the environment of managed network 300.

Task list 502 represents a list of activities that proxy servers 312 are to perform on behalf of computational instance 322. As discovery takes place, task list 502 is populated. Proxy servers 312 repeatedly query task list 502, obtain the next task therein, and perform this task until task list 502 is empty or another stopping condition has been reached.

To facilitate discovery, proxy servers 312 may be configured with information regarding one or more subnets in managed network 300 that are reachable by way of proxy servers 312. For instance, proxy servers 312 may be given the IP address range 192.168.0/24 as a subnet. Then, computational instance 322 may store this information in CMDB 500 and place tasks in task list 502 for discovery of devices at each of these addresses.

FIG. 5A also depicts devices, applications, and services in managed network 300 as configuration items 504, 506, 508, 510, and 512. As noted above, these configuration items represent a set of physical and/or virtual devices (e.g., client devices, server devices, routers, or virtual machines), applications executing thereon (e.g., web servers, email servers, databases, or storage arrays), relationships therebetween, as well as services that involve multiple individual configuration items.

Placing the tasks in task list 502 may trigger or otherwise cause proxy servers 312 to begin discovery. Alternatively or additionally, discovery may be manually triggered or automatically triggered based on triggering events (e.g., discovery may automatically begin once per day at a particular time).

In general, discovery may proceed in four logical phases: scanning, classification, identification, and exploration. Each phase of discovery involves various types of probe messages being transmitted by proxy servers 312 to one or more devices in managed network 300. The responses to these probes may be received and processed by proxy servers 312, and representations thereof may be transmitted to CMDB 500. Thus, each phase can result in more configuration items being discovered and stored in CMDB 500.

In the scanning phase, proxy servers 312 may probe each IP address in the specified range of IP addresses for open Transmission Control Protocol (TCP) and/or User Datagram Protocol (UDP) ports to determine the general type of device. The presence of such open ports at an IP address may indicate that a particular application is operating on the device that is assigned the IP address, which in turn may identify the operating system used by the device. For example, if TCP port 135 is open, then the device is likely executing a WINDOWS® operating system. Similarly, if TCP port 22 is open, then the device is likely executing a UNIX® operating system, such as LINUX®. If UDP port 161 is open, then the device may be able to be further identified through the Simple Network Management Protocol (SNMP). Other possibilities exist. Once the presence of a device at a particular IP address and its open ports have been discovered, these configuration items are saved in CMDB 500.

In the classification phase, proxy servers 312 may further probe each discovered device to determine the version of its operating system. The probes used for a particular device are based on information gathered about the devices during the scanning phase. For example, if a device is found with TCP port 22 open, a set of UNIX®-specific probes may be used. Likewise, if a device is found with TCP port 135 open, a set of WINDOWS®-specific probes may be used. For either case, an appropriate set of tasks may be placed in task list 502 for proxy servers 312 to carry out. These tasks may result in proxy servers 312 logging on, or otherwise accessing information from the particular device. For instance, if TCP port 22 is open, proxy servers 312 may be instructed to initiate a Secure Shell (SSH) connection to the particular device and obtain information about the operating system thereon from particular locations in the file system. Based on this information, the operating system may be determined. As an example, a UNIX® device with TCP port 22 open may be classified as AIX®, HPUX, LINUX®, MACOS®, or SOLARIS®. This classification information may be stored as one or more configuration items in CMDB 500.

In the identification phase, proxy servers 312 may determine specific details about a classified device. The probes used during this phase may be based on information gathered about the particular devices during the classification phase. For example, if a device was classified as LINUX®, a set of LINUX®-specific probes may be used. Likewise if a device was classified as WINDOWS® 2012, as a set of WINDOWS®-2012-specific probes may be used. As was the case for the classification phase, an appropriate set of tasks may be placed in task list 502 for proxy servers 312 to carry out. These tasks may result in proxy servers 312 reading information from the particular device, such as basic input/output system (BIOS) information, serial numbers, network interface information, media access control address (es) assigned to these network interface(s), IP address(es) used by the particular device and so on. This identification information may be stored as one or more configuration items in CMDB 500.

In the exploration phase, proxy servers 312 may determine further details about the operational state of a classified device. The probes used during this phase may be based on information gathered about the particular devices during the classification phase and/or the identification phase. Again, an appropriate set of tasks may be placed in task list 502 for proxy servers 312 to carry out. These tasks may result in proxy servers 312 reading additional information from the particular device, such as processor information, memory information, lists of running processes (applications), and so on. Once more, the discovered information may be stored as one or more configuration items in CMDB 500.

Running discovery on a network device, such as a router, may utilize SNMP. Instead of or in addition to determining a list of running processes or other application-related information, discovery may determine additional subnets known to the router and the operational state of the router's network interfaces (e.g., active, inactive, queue length, number of packets dropped, etc.). The IP addresses of the additional subnets may be candidates for further discovery procedures. Thus, discovery may progress iteratively or recursively.

Once discovery completes, a snapshot representation of each discovered device, application, and service is available in CMDB 500. For example, after discovery, operating system version, hardware configuration and network configuration details for client devices, server devices, and routers in managed network 300, as well as applications executing thereon, may be stored. This collected information may be presented to a user in various ways to allow the user to view the hardware composition and operational status of devices, as well as the characteristics of services that span multiple devices and applications.

Furthermore, CMDB 500 may include entries regarding dependencies and relationships between configuration items. More specifically, an application that is executing on a particular server device, as well as the services that rely on this application, may be represented as such in CMDB 500. For instance, suppose that a database application is executing on a server device, and that this database application is used by a new employee onboarding service as well as a payroll service. Thus, if the server device is taken out of operation for maintenance, it is clear that the employee onboarding service and payroll service will be impacted. Likewise, the dependencies and relationships between configuration items may be able to represent the services impacted when a particular router fails.

In general, dependencies and relationships between configuration items may be displayed on a web-based interface and represented in a hierarchical fashion. Thus, adding, changing, or removing such dependencies and relationships may be accomplished by way of this interface.

Furthermore, users from managed network 300 may develop workflows that allow certain coordinated activities to take place across multiple discovered devices. For instance, an IT workflow might allow the user to change the common administrator password to all discovered LINUX® devices in single operation.

In order for discovery to take place in the manner described above, proxy servers 312, CMDB 500, and/or one or more credential stores may be configured with credentials for one or more of the devices to be discovered. Credentials may include any type of information needed in order to access the devices. These may include userid/password pairs, certificates, and so on. In some embodiments, these credentials may be stored in encrypted fields of CMDB 500. Proxy servers 312 may contain the decryption key for the credentials so that proxy servers 312 can use these credentials to log on to or otherwise access devices being discovered.

Figure 5B:
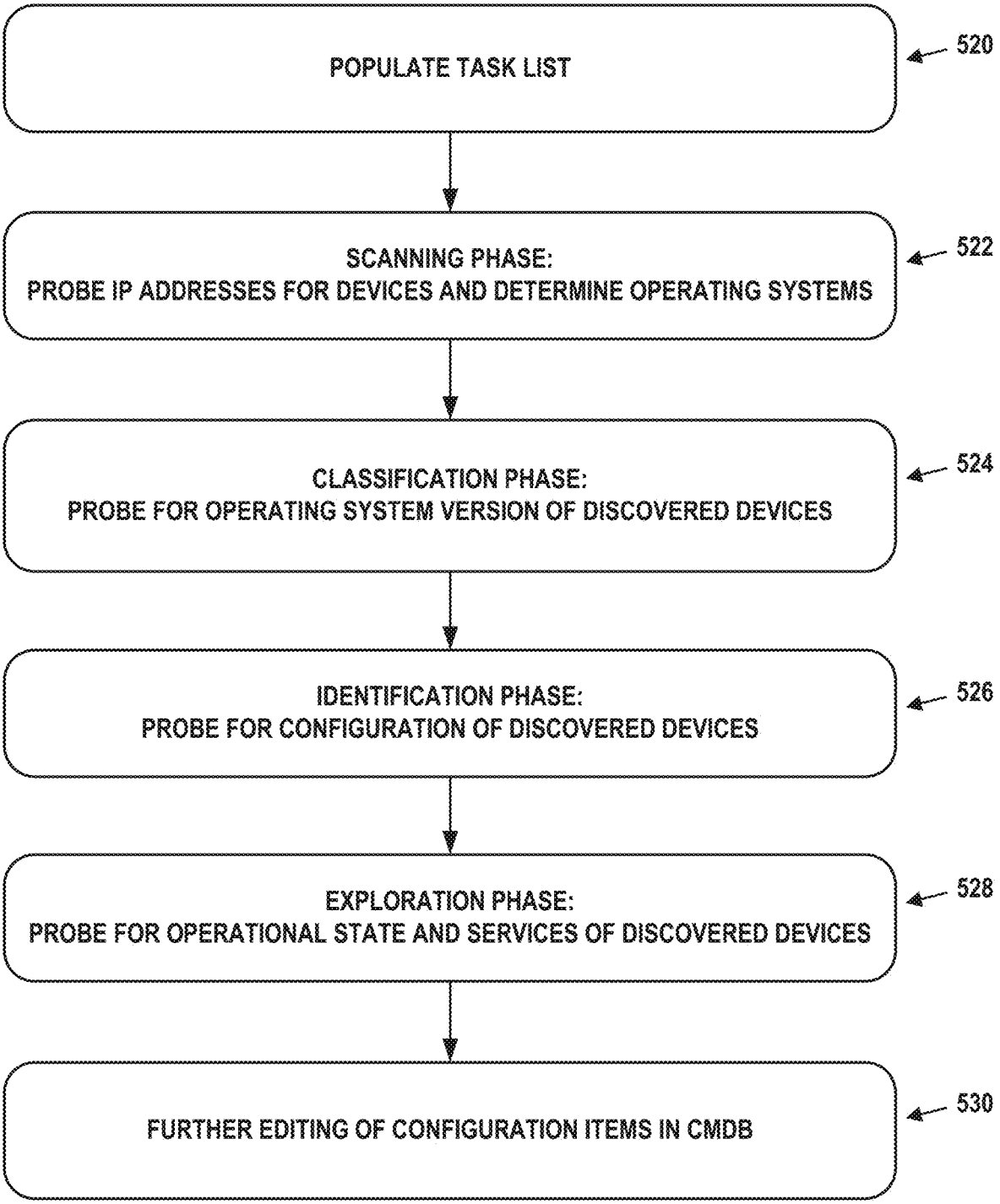
FIG. 5B is a flow chart, in accordance with example embodiments.

The discovery process is depicted as a flow chart in FIG. 5B. At block 520, the task list in the computational instance is populated, for instance, with a range of IP addresses. At block 522, the scanning phase takes place. Thus, the proxy servers probe the IP addresses for devices using these IP addresses, and attempt to determine the operating systems that are executing on these devices. At block 524, the classification phase takes place. The proxy servers attempt to determine the operating system version of the discovered devices. At block 526, the identification phase takes place. The proxy servers attempt to determine the hardware and/or software configuration of the discovered devices. At block 528, the exploration phase takes place. The proxy servers attempt to determine the operational state and applications executing on the discovered devices. At block 530, further editing of the configuration items representing the discovered devices and applications may take place. This editing may be automated and/or manual in nature.

The blocks represented in FIG. 5B are for purpose of example. Discovery may be a highly configurable procedure that can have more or fewer phases, and the operations of each phase may vary. In some cases, one or more phases may be customized, or may otherwise deviate from the exemplary descriptions above.

V. Example Adaptation of Audio Notifications

Example embodiments of systems and methods for mapping specific event characteristics to audio properties are described herein by way of example primarily in terms of event notification used in network management. In a typical arrangement, certain operations of network management may be physically and/or virtually centrally organized within a "network operations center" or "NOC." In an example embodiment, a NOC may include various servers, databases, communication devices, and control functions in one or more physical locations, and may be staffed by IT service personnel responsible for monitoring and maintaining network health and operations. As such, event occurrences in on or more remote networks managed at or by the NOC may be received at the NOC, and adapted as audio event notifications, instead of or in addition to visual notifications, on client devices of IT personnel. In at least some configurations, IT personnel may also be able to work remotely from a physical NOC, receiving event notifications on remote and/or mobile client devices, for example.

As described above, managed networks may also support operations in organizations and enterprises, as well in other possible contexts. Accordingly, application and/or use of the systems and methods for mapping specific event characteristics to audio properties illustratively described herein are not limited to event notification in management and operations of networks, but may be applied or used in any context in which event notifications play a role.

As mentioned above, network management may involve IT personnel who handle conditions that give rise to occurrences of events. For purposes of the present discussion, IT personnel, or other personnel who receive event notifications as part of a process flow for handling events, are referred to herein simply as "users" (or "user" in the singular). This is not necessarily intended to imply anything about the significance of their role in managing network health and operations. Rather, it is meant only to physically position them relative to the various modes and aspects of information flow that are described herein.

Figure 6:
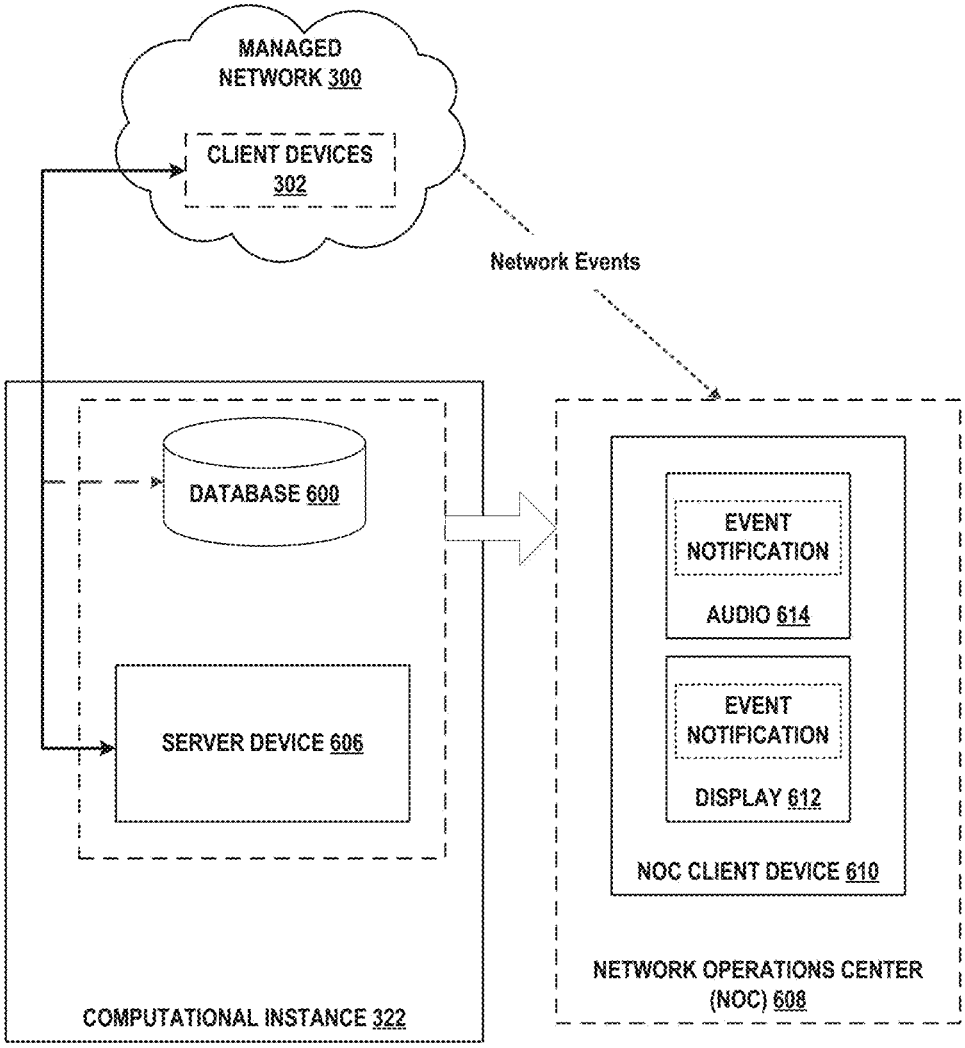
FIG. 6 illustrates a schematic drawing of certain elements of a system for adapting audio notifications, in accordance with example embodiments.

FIG. 6 illustrates a schematic drawing of certain elements of a system for adapting audio notifications, in accordance with example embodiments. In the example illustrated, the system may be disposed within a computational instance 322 of a remote network management platform. As described above, the computational instance may be associated with a managed network 300, which, for the sake of clarity in FIG. 6, is shown with only client devices 302 included. As illustrated, the system may include a server device 606 and a database 600, and may be associated with a managed network 300. The client devices 302, database 600, and servers 606 may be communicatively connected, as indicated by the connecting arrows in the figure.

In an example embodiment, the server 606 and database 600 may function together to provide at least some aspects of a Network Operations Center (NOC) 608, shown as a dashed box in FIG. 6 that corresponds to another dashed box enclosing the server device 606 and database 600 in the computational instance 322. As described below, the server 606 may host software components and/or applications that carry out various actions and operations disclosed herein. The database 600 may store, possibly among other data, information used in processing information about events to properties and/or features of event notification that are presented to users (e.g., IT personnel).

The NOC 608 is also includes NOC client devices 610, which in turn may include display 612 and audio component 614. The NOC 608 does not necessarily have to reside physically within the computational instance 322, although such an arrangement is not excluded. Rather, the server 606 and database 600 may provide at least some of the hardware and software infrastructure for implementing the NOC 608. The NOC client devices 608 may also be considered part of the NOC 608.

In example operation, the NOC 608 may receive communications (e.g., messages) from the managed network 300 for events that occur within, or associated with, the network. This is represented in FIG. 6 by dotted arrow pointing labeled "Network Events" and pointing from the managed network 300 to the NOC 608. The physical path for these communications may be the connections between the client devices 302 and the database 600 and server 606 indicated in FIG. 6.

In accordance with example embodiments, the event occurrences may be communicated in event messages or other form of data transmissions. Event messages may be sent from one or another computing device in the managed network 300 in response to interactive input and/or as part of an automated monitoring procedure. For example, an end user in the network 300 might report a network condition by entering information at a client device 302. As another example, a network switch or router might autonomously and/or automatically send a message to report network congestion or some other performance problem. By way of example, and without loss of generality herein, a client device 302 may be taken as the source of an event message in the network 300. It will be appreciated that there could be other sources of event messages in a remotely managed network.

Upon receiving an event message, the server 606 may process the message to determine specific event characteristics, and then generate an event notification for one or more NOC client devices 608 to display visually and/or play out as an audio notification. In particular, example embodiments herein are directed to how event characteristics that may be used to determine certain visual aspects of visual event notifications may be mapped to audio aspects of audio notifications. Doing so may therefore adapt audio notifications to specific event characteristics. Visual event notifications are briefly considered first, as they may provide context for how audio notifications may be adapted to the full advantage of both the information carried in event messages and individual user preferences and real-time circumstances.

Figure 7:
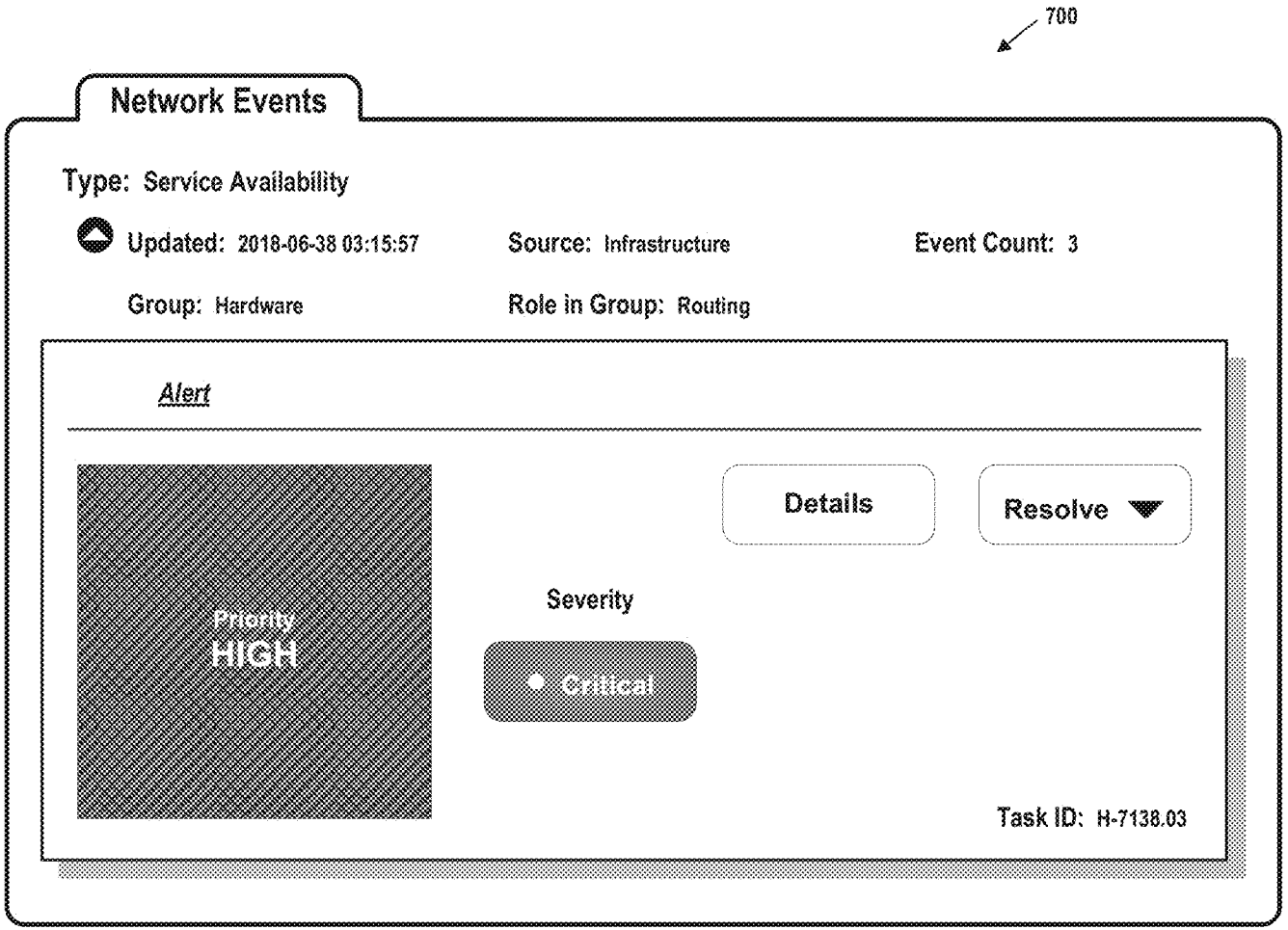
FIG. 7 depicts an example visual event notification, in accordance with example embodiments.

FIG. 7 depicts an example visual event notification 700, in accordance with example embodiments. By way of example, the visual event notification 700 is represented as a webpage tab, such as may be displayed in a browser window in a display device of component of a client device. In the example illustrated, the visual event notification 700 includes a tab bar labeled "Network Event," and general information indicating that the particular network event is of "Type" identified as "Service Availability." Other information includes a timestamp indicating when the event status was updated, the reporting "Source" of the event ("Infrastructure" in this example), an event count, a group responsible for handling the event, and a role for the group. It will be appreciated that the information displayed in a visual notification may vary, and that the information depicted in the event notification 700 is not limiting with respect to embodiments herein.

In the example, the visual event notification also includes a sub-window identifying the notification as an "Alert," as well as an indicator of "HIGH" priority and another indicator of "Critical" severity. The sub-window in this example also includes an interactive button linked to "Details" and a pull-down action mention (currently set to "Resolve").

By way of example in FIG. 7, the priority information and severity information are depicted with particular graphical properties. For example, the priority is presented in white letters on a cross-hatched gray background filling a large square. The severity is present is white letters on a gray background filling a rectangle. In practice, these graphical properties, represented in black-and-white in FIG. 7, may be rendered in color on a display device, with sizes and colors determined according to the associated event characteristics. As such, the sizes, colors and/or other visual properties of the associated indicators may serve as visual cues relating to the associated event characteristics. For example the background colors of the priority and severity could be red in order to indicate the significance or importance of "HIGH" and "Critical" in this example. Other colors could be used for other levels of priority and/or severity. In an example embodiment, the determination of how to render the visual cues may be made by the server device 606 according to information contained in the event message received from the managed network 300.

Figure 8:
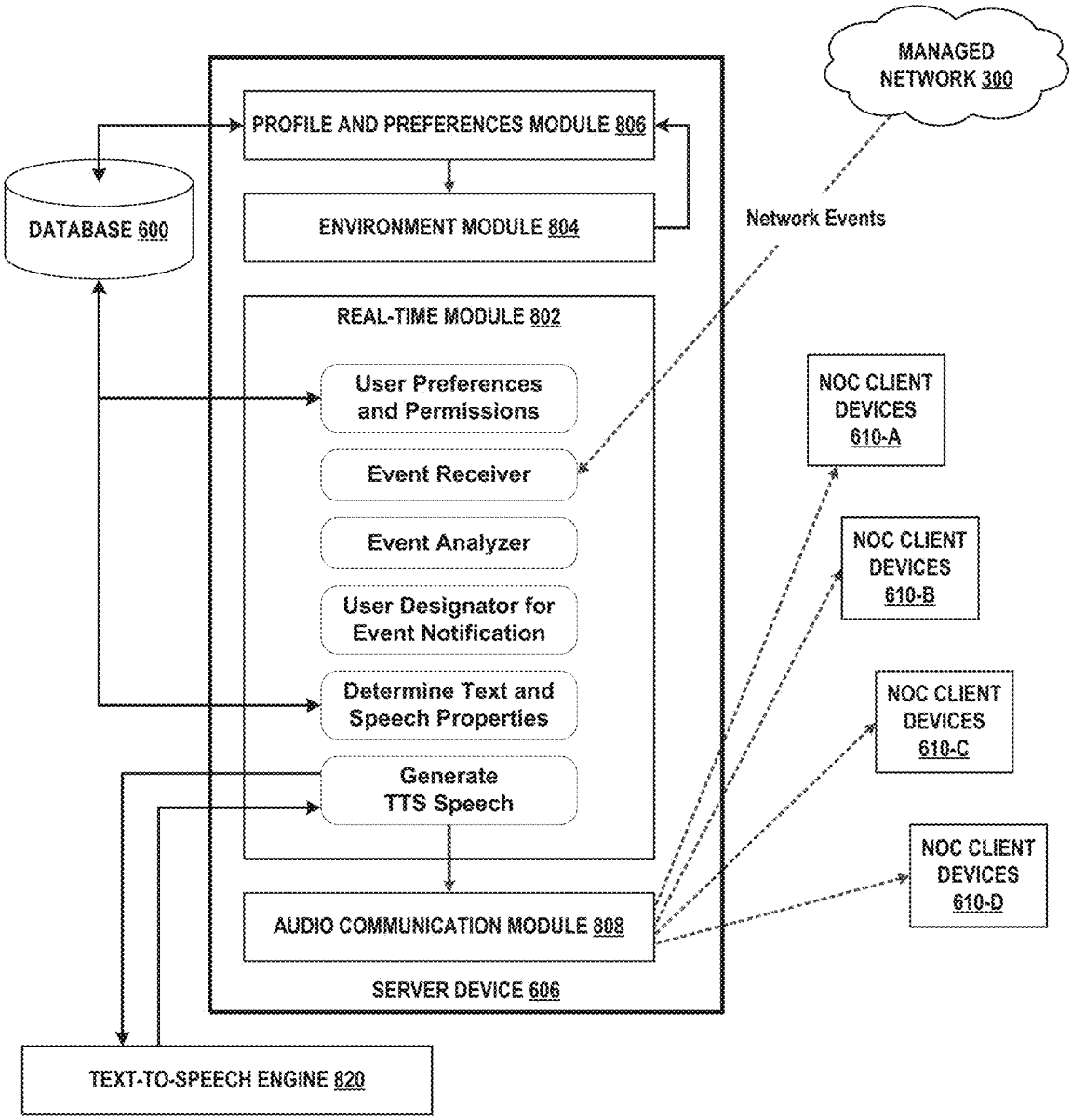
FIG. 8 illustrates an example architecture of a system for adapting audio notifications, in accordance with example embodiments.

FIG. 8 illustrates an example architecture of a system for adapting audio notifications, in accordance with example embodiments. The example architecture includes various "modules" implemented within the server device 606, as well as the database 600, which may store user-specific preference information for mapping event characteristics to audio and speech characteristics of audio notifications. In accordance with example embodiments, the modules include a real-time module 802, an environment module 804, a profile and preferences module 806, and an audio communication module 808. In addition, the system may be communicatively connected with a text-to-speech (TTS) engine 820. In an example embodiment, the TTS engine 820 may be an existing facility provided by a third party. Examples of third party TTS engines may include Google Cloud Text-To-Speech® and Amazon Polly®.

While the modules of the example architecture are depicted within one server device 606, other configurations are possible as well. For example, the modules may be distributed among multiple server devices. As another example, one or more of the modules may be implemented in different types of computing devices, besides servers.

Other arrangements are possible as well. In addition, modules may be implemented as software programs or applications, firmware instructions, hardware component modules, or a mix of any two or more of these forms of implementations.

In accordance with example embodiments, the real-time module may integrate functional operations relating to receiving and processing event messages, and then generating appropriate audio notifications and transmitting them to one or more NOC client devices, exemplified in FIG. 8 as NOC client devices 610-A, 610-B, 610-C, and 610-D. The profile and preferences module 806 may provide operations for customizing user-specific information in the database 600, while the environment module may collect environment information relating the given users and/or their associated client devices, and then update the profile and preferences module 806 with the most recent environment information. The audio communications module may handle transmission of audio notifications to the appropriate NOC client device(s). Further details of the modules may be illustrated by considering example operation of network event message processing by the system, as described below.

Example operation in accordance with example embodiments may involve network events being sent from the managed network 300 to an event receiver function, as shown in FIG. 8. The received message may then be processed and analyzed by the event analyzer function. This operation may be used to determine specific event characteristics. Non-limiting examples of event characteristics include event type, event severity, and event priority. The specific event characteristics may be used to determine which user or users should receive the event notification, as well as a text message associated with the event, and speech properties that TTS engine 820 should apply when it generates synthesized speech of the text message.

In further accordance with example embodiments, a user designator function may use information from the event analyzer to assign or designate a particular user to receive the event notification. This determination could be based on the event type, or other event characteristic, for example. In some applications and/or for some event more than one particular user may be identified and designated to receive event notification.

Event characteristic information may then also be used to determine an appropriate text message that should be associated with the event, as indicated by the corresponding functional operation in the real-time module 802. For example, an event characteristic may include a description of a network condition that caused the event occurrence, and this description could be the basis for a text notification. As another example, the system may store a collection of predefined text messages that may be associated with specific event types. In this example, a determined event type could be used to find an appropriate, predefined text message.

In accordance with example embodiments, one or more of the specific event characteristics may be used to determine specific speech characteristics and/or audio properties that a spoken version of the text notification should have for the particular user. More specifically, the database 600 may be queried or consulted to retrieve user-specific information regarding preferences for the particular user. By way of example, the database 600 may contain for each user a record that includes user-specific parameters for mapping specific event characteristics to speech characteristics that should be used when generating synthesized speech of text messages. Non-limiting examples of speech characteristics may include volume, pitch, tone, speed, and preferred language. The user-specific parameters may thus specify appropriate values or other data that control or encode selected values or levels, for example, of the associated speech characteristics. The user-specific parameters may in turn be set according to the specific event characteristics as determined by the event analyzer function.

In accordance with example embodiments, a given user may customize her/his user-specific parameters in the database 600. As indicated, this customization functionality may be provided by a user preferences and permissions functional operation in the real-time module 802 communicating with the profile and preferences module 806, which in turn updates user records according to user input. Thus, in determining speech characteristics for an audio notification to the particular user, the database record consulted may include customizations set by the particular user.

In further accordance with example embodiments, the user-specific parameters may also include additional parameters that may be set according to one or more real-time environment conditions of the particular user. Non-limiting examples of real-time conditions may include the particular user's geolocation, motion, velocity, current client device, device capabilities, and device operational status (e.g., headphones in use, microphone on, etc.). Parameters corresponding to real-time environment conditions of a given user may either be associated with additional audio properties or be used to modify existing speech characteristics by modifying the associated user-specific parameters. For example, an audio property that specifies playout through headphones may be considered an additional property, while an audio property that adjusts volume for playout through headphones may be considered a modifying of an existing speech characteristic.

In accordance with example embodiments, the environment module 804 may operate to monitor real-time environment conditions or properties of a given user's client device, and to update the profile and preferences module 806 accordingly, as indicated by the arrow from the environment module 804 to the profile and preferences module 806. The profile and preferences module 806 may then update the given user's record with the real-time information. As described below, monitoring may be subject permissions granted or not granted by the givne user. Thus, a given user may control whether this system monitoring is permitted, and which properties may be monitored.

More particularly, the parameters corresponding to the one or more real-time environment conditions of a given user may have permissions associated with them, such that a given user may selectively set which real-time environment conditions may be monitored. In further accordance with example embodiments, the given user may provide permissions and real-time setting via the user preferences and permissions functional operation in the real-time module 802, which in turn may communicate with the profile and preferences module 806 to set the associated parameters and permissions in the given user's record in the database 600. These permissions may the control whether the environment module is allowed to monitor the given user's client device, and which environment properties may be monitored.

Once a particular user has been designated to receive an audio notification, a text message is determined, and speech characteristics and real-time audio properties have been determined, a speech generation functional operation may transmit the text message and the associated characteristics and properties to the TTS engine 820. In accordance with example embodiments, the TTS engine 820, whether supplied by a third party or provided within the in-house system, may include capabilities to synthesize speech not only according to the written text message, but also with speech characteristics and/or audio properties specified in the transmission to the TTS engine. For example, speech speed, volume, pitch, tone, and language may be specified when supplying the text message to the TTS engine 820.

In further accordance with example embodiments, the TTS engine 820 may then generate an audio recording of the synthesized speech adapted according the specified speech characteristics and/or audio properties, and then return in to the speech generation functional operation. The speech generation functional operation may then provide the audio recording to the audio communication module 808, which transmits (or controls transmission of) the audio recording to one or more NOC client devices 610-A, 610-B, 610-C, or 610-D. The audio recording may be already adapted to the particular device type. In the example operation illustrated, the different NOC client devices may represent different devices that a particular user may use at different times and/or under difference circumstances. For example, one device might be the particular user's mobile device, while another might be a NOC client device located in the NOC, and still another might be a desktop computer at a remote location. Additionally or alternatively, the different NOC client devices shown might be associated with different users. These are just two examples.

Upon receiving the audio recording, each of the one or more NOC client devices 610-A, 610-B, 610-C, and 610-D may then play out the audio event notification which speech characteristics and/or real-time audio properties adapted to the specific event and to the user's real-time environment properties. For example, a HIGH priority and Critical severity alert may be played out at high volume and a pitch that gets the particular user's attention. Since the speech properties for different event characteristics may be set by the particular user, the playout is customized to audio cues preferred by the particular user for different event characteristics.

FIG. 9 illustrates an example record format for user parameters in a database of example system for adapting audio notifications in accordance with example embodiments. The format is displayed in the form of a table 900 in which each row corresponds to a different user, and the columns specify parameter for mapping event characteristics to speech characteristics and real-time audio properties. It will be appreciated that example table 900 may not necessarily represent a complete set of parameters, and is not limiting with respect to other possible data formats and schemes.

The top row 902 of table 900 displays example column headings. As shown, the first column identifies a user associated with a given row. By way of example three users are shown in rows 904, 906, and 908. The second column specifies pitch and tone ranges associated with priority, where priority may be taken to be direct or derived event characteristic. The third column specifies volume and speed ranges associated with severity, where severity may also be taken to be direct or derived event characteristic. The fourth column specifies permissions for coded real-time properties, and the fifth column specifies coded parameter values for the associated permissions.

Interpretation and use of the table 900 may be illustrated by way of an operational example. It should be appreciated that the example table and operation are not limiting with respect to example embodiments herein, but rather serve to show how specific event characteristics may be mapped to speech characteristics and real-time audio properties.

In the example illustrated, a given user may select a minimum and maximum parameter value for each of the speech characteristics associated with priority and severity. In this example, pitch and tone ranges are associated with priority, and volume and speed ranges are associated with severity. In operation, the system may choose a value within a given range according to a specific event characteristic. For example, HIGH priority may map to 90% of the ranges for pitch and tone, while low priority might map to 20% of those ranges. Similar considerations may be applied to volume and speed ranges associated with severity. Note that other associations of event characteristics and speech characteristics are possible, besides the examples shown. For instance, priority might be associated (mapped to) speed instead of or in addition to pitch and/or tone.

In the example, permissions have a descriptive code and are set with a one or zero depending on whether or not a real-time property associated with the code may be monitored. By way of example, the codes are "D" for device monitoring, "C" for capability monitoring, "S" for status monitoring, "H" for headphone use monitoring, "L" for location monitoring, "V" for velocity monitoring, and "N" for noise level monitoring. A one in the position of any one of these codes grants permission for monitoring; a zero denies permission. The codes are repeated in the "Device/Environment" column, but the settings correspond to which speech parameters may be modified according to the corresponding permission. Again by way of example, "p" indicates that pitch should be modified, "s" indicates that speed should be modified, "v" indicates that volume should be modified, and "t" indicates that tone should be modified.

Following the example settings described above, it may be seen that user Dean A (row 902) has set pitch and tone ranges to [20, 80] and [20, 100], respectively, and set volume and speed ranges to [25, 75] and [30, 70], respectively. Dean A has also granted permissions for all monitoring, except for location. As also illustrated by way of example, Dean A has associated device type with pitch modification, capabilities with speed modification, device status with volume modification, headphone usage with volume modification, location (for which monitoring is not permitted) with tone modification, velocity with volume modification, and noise level with tone modification.

The above example table and table usage may be considered a simplification of a more complete configuration. However, the illustration serves to show how the basic scheme of how user-specific parameter and real-time monitoring may be used to adapt audio notifications to users may be implemented. It will be appreciated that more or fewer parameters may be used, and the associations between event characteristics and speed characteristics may be different from the ones shown.

VI. Example Methods

Figure 10:
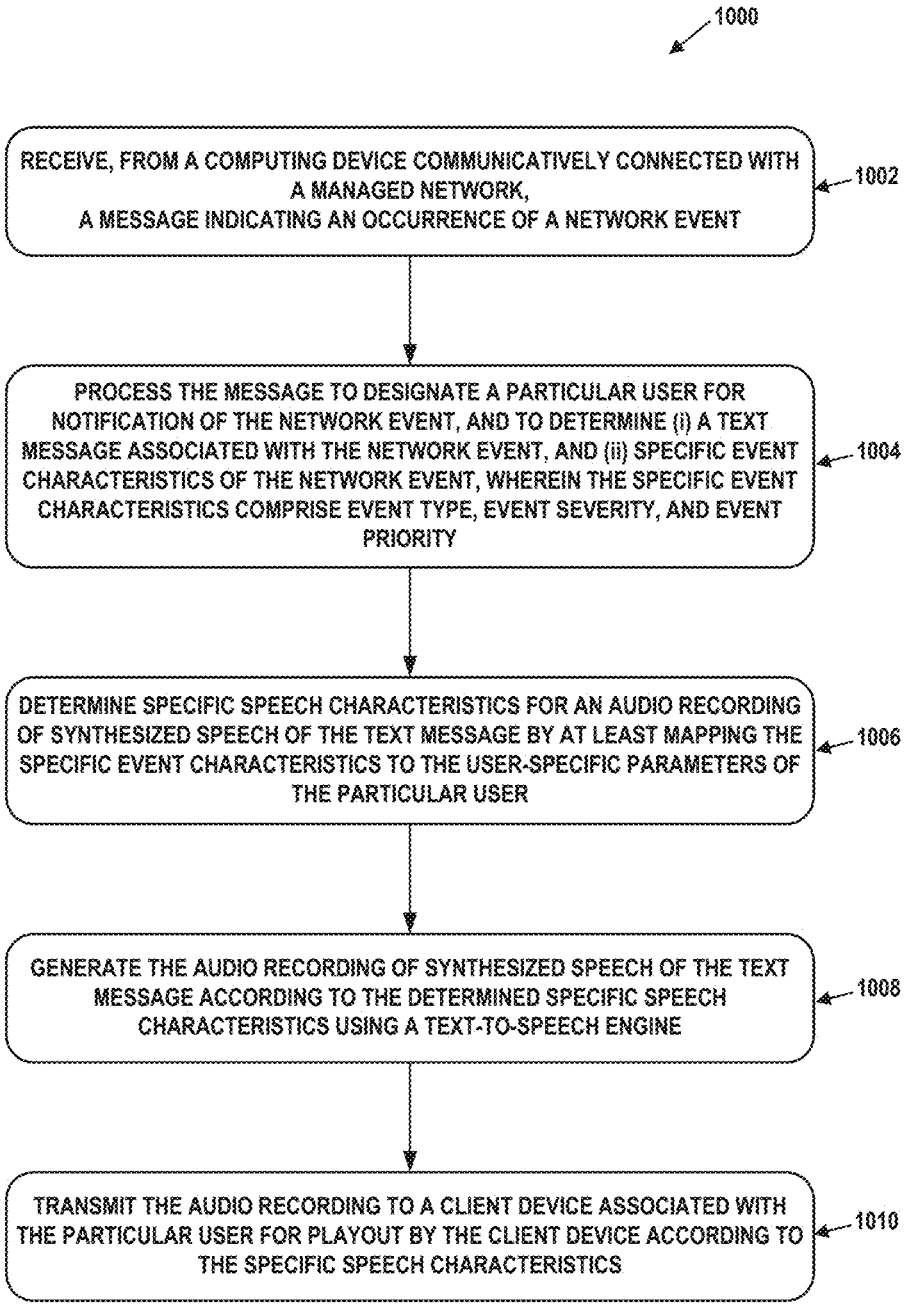
FIG. 10 is a flow chart, in accordance with example embodiments.

FIG. 10 is a flow chart illustrating an example embodiment of a method 1000 for adapting audio notifications associated with events in a managed network of a computational instance of a remote network management platform. The method illustrated by FIG. 10 may be carried out by a computing device, such as computing device 100, and/or a cluster of computing devices, such as server cluster 200. However, the process can be carried out by other types of devices or device subsystems. For example, the method could be carried out by a portable computer, such as a laptop or a tablet device.

The embodiments of FIG. 10 may be simplified by the removal of any one or more of the features shown therein. Further, these embodiments may be combined with features, aspects, and/or implementations of any of the previous figures or otherwise described herein.

In an example embodiment, the method 1000 may be implemented in a system disposed within the computational instance 322. The system may include a server device disposed within a computational instance, such as server device 606 in instance 322, of a remote network management platform, such as platform 320, which remotely manages a managed network, such as network 300. The system may also include a database configured for storing speech-characteristics parameters for mapping event characteristics to speech characteristics. In accordance with example embodiments, the database may contain records, each of which may be associated with a respective user, and each of which may include user-specific parameters for mapping event characteristics to speech characteristics. Further, the user-specific parameters may be customizable according to the respective user. The speech characteristics may include at least one of volume, pitch, tone, or speed. In an example embodiment, the user-specific parameters may set or code values associated with the speech characteristics. Operations of the example method 1000 may be carried out by the server.

Block 1002 may involve the server receiving, from a computing device communicatively connected with the managed network, a message indicating an occurrence of a network event. For example, the computing device may be configured for monitoring the managed network for events, such as hardware problems or other network issues. As another example, computing device may receive interactive input from IT personnel reporting an event or network issue. These are non-limiting examples.

Block 1004 may involve the server device processing the message to designate a particular user for notification of the network event, and to determine (i) a text message associated with the network event, and (ii) specific event characteristics of the network event, wherein the specific event characteristics comprise event type, event severity, and event priority. For example, the particular user may be one of a team of network management personnel assigned to handling a predefined set of event types or event classes, or some other categorization of events. In accordance with example embodiments, the message may indicate the event type, as well as the specific event characteristics.

Block 1006 may involve the server device determining specific speech characteristics for an audio recording of synthesized speech of the text message by at least mapping the specific event characteristics to the user-specific parameters of the particular user. In accordance with example embodiments, once the particular user has been designated for receiving the notification of the network event, the database record associated with the particular user may be consulted and the user-specific parameters of the particular user obtained or retrieved.

Block 1008 may involve the server device generating the audio recording of synthesized speech of the text message according to the determined specific speech characteristics using a text-to-speech (TTS) engine. In an example embodiment, TTS engine may be external to the system, and, further, may be supplied by a third party TTS vendor/organization or application. In other embodiments, the TTS engine may be internal to the system, or internal to the remote network management platform.

Finally, block 1110 may involve transmitting the audio recording to a client device associated with the particular user for playout by the client device according to the specific speech characteristics. In accordance with example embodiments, the transmission may be directed to more than one client device associated with the particular user, or to a given one of multiple client devices associated with the particular user. As described below, the given client device may be selected based on a real-time determination of which of the multiple client devices the particular user is using at the time the network event is received. In further accordance with example embodiments, the specific speech characteristics may also be determined according to the type of the given client device, so that playout of the audio recording according to the specific speech characteristics is appropriate for the given client device.

In accordance with example embodiments, example method 1000 may further entail adapting the notification for one or more additional users, besides the particular user. Specifically, the method 1000 may further entail determining different specific speech characteristics for a different audio recording of different synthesized speech of the text message by mapping the specific event characteristics to the user specific parameters of the different user. The different audio recording of the text message may be generated according to the determined different specific speech characteristics using the text-to-speech engine, and then transmitted to a different client device associated with the different user for playout by the different client device according to the different specific speech characteristics.

In accordance with example embodiments, a user-specific parameter may specify an individual value for a corresponding speech characteristic, and/or may specify a value range for a corresponding speech characteristic. More specifically, the user-specific parameters may be used to set (i) a value for a corresponding at least one of the speech characteristics, and/or (ii) a value range between a minimum and a maximum for a corresponding at least one of the speech characteristics. Then mapping the specific event characteristics to the user-specific parameters of the particular user may entail selecting (i) a particular value for the corresponding at least one speech characteristic based on at least one of the specific event characteristics, and/or (ii) a value between the minimum and maximum for the corresponding at least one speech characteristic based on at least one of the specific event characteristics. That is, a specific event characteristic may map to a particular parameter associated with a speech characteristic, or may be used to set a value within a specified range.

In further accordance with example embodiments, example method 1000 may further entail adapting the audio notification according to real-time factors that may apply to the particular user. Specifically, the specific speech characteristics may include environment-based audio properties for adapting playout of the audio recording according to one or more real-time physical environment properties of the client device. Thus, the method 1000 may further entail determining the one or more real-time physical environment properties of the client device. And as such determining the specific speech characteristics for the audio recording of synthesized speech of the text message may further entail determining the environment-based audio properties based on at least one of the one or more physical environment properties of the client device.

In further accordance with example embodiments, the one or more real-time physical environment properties of the client device may be any one or more of: device audio capabilities, device audio settings status, geographic location, motion, velocity, or ambient noise level. Non-limiting audio settings status may include whether headphones are currently being, and/or whether a microphone is currently enabled. The environment-based audio properties may be one or more of: (i) an audio property not already determined by mapping the specific event characteristics to the user specific parameters of the particular user, or (ii) a modification of a specific speech characteristic already determined by mapping the specific event characteristics to the user specific parameters of the particular user, the modification being based on at least one of the one or more physical environment properties of the client device. That is, an environment-based audio property may extend the list of specific speech characteristics, or may be used to modify a specific speech characteristic set according to mapping based on the user-specific parameters.

In accordance with example embodiments, method 1000 may further include procedures for a given user to customize her/his user-specific parameters. Customization procedures may enable a given user to set both non-real-time user-specific parameters, as well as to specify how real-time environment parameters may be determined. Thus, method 1000 may further entail receiving, via a user interface, interactive user data for customizing the user-specific parameters of any given one of the database records.

In further accordance with example embodiments, the user-specific parameters of each record may include: (i) one or more user-settable permissions to monitor one or more corresponding physical environment properties of a respective client device associated with a respective user; and (ii) an environment parameter associated with each of the one or more user-settable permissions. Example method 1000 may then further entail real-time monitoring of the respective user according to whether or not particular permissions have been granted. Specifically, if the user-settable permissions of a particular user grant permission to monitor one or more current physical environment properties, then those one or more current physical environment properties of the client device associated with the particular user may be determined from real-time monitoring. Then at least one environment parameter for which permission has been granted may be updated according to the permitted real-time monitoring.

In further accordance with example embodiments, determining the specific speech characteristics for the audio recording of the synthesized speech of the text message may thus entail determining the specific speech characteristics based on both the user-specific parameters of the particular user as customized via the user interface, and any one or more environment parameters associated with a granted user-settable permission.

In accordance with example embodiments, the user-specific parameters of each record may have default settings in the absence being customized according to the respective user. That is, a user need not necessarily set user-specific parameter values for example method 1000 to be operable. Default values may be set in the database records.

VII. Conclusion

The present disclosure is not to be limited in terms of the particular embodiments described in this application, which are intended as illustrations of various aspects. Many modifications and variations can be made without departing from its scope, as will be apparent to those skilled in the art. Functionally equivalent methods and apparatuses within the scope of the disclosure, in addition to those described herein, will be apparent to those skilled in the art from the foregoing descriptions. Such modifications and variations are intended to fall within the scope of the appended claims.

The above detailed description describes various features and operations of the disclosed systems, devices, and methods with reference to the accompanying figures. The example embodiments described herein and in the figures are not meant to be limiting. Other embodiments can be utilized, and other changes can be made, without departing from the scope of the subject matter presented herein. It will be readily understood that the aspects of the present disclosure, as generally described herein, and illustrated in the figures, can be arranged, substituted, combined, separated, and designed in a wide variety of different configurations.

With respect to any or all of the message flow diagrams, scenarios, and flow charts in the figures and as discussed herein, each step, block, and/or communication can represent a processing of information and/or a transmission of information in accordance with example embodiments. Alternative embodiments are included within the scope of these example embodiments. In these alternative embodiments, for example, operations described as steps, blocks, transmissions, communications, requests, responses, and/or messages can be executed out of order from that shown or discussed, including substantially concurrently or in reverse order, depending on the functionality involved. Further, more or fewer blocks and/or operations can be used with any of the message flow diagrams, scenarios, and flow charts discussed herein, and these message flow diagrams, scenarios, and flow charts can be combined with one another, in part or in whole.

A step or block that represents a processing of information can correspond to circuitry that can be configured to perform the specific logical functions of a herein-described method or technique. Alternatively or additionally, a step or block that represents a processing of information can correspond to a module, a segment, or a portion of program code (including related data). The program code can include one or more instructions executable by a processor for implementing specific logical operations or actions in the method or technique. The program code and/or related data can be stored on any type of computer readable medium such as a storage device including RAM, a disk drive, a solid state drive, or another storage medium.

The computer readable medium can also include non-transitory computer readable media such as computer readable media that store data for short periods of time like register memory and processor cache. The computer readable media can further include non-transitory computer readable media that store program code and/or data for longer periods of time. Thus, the computer readable media may include secondary or persistent long term storage, like ROM, optical or magnetic disks, solid state drives, compact-disc read only memory (CD-ROM), for example. The computer readable media can also be any other volatile or non-volatile storage systems. A computer readable medium can be considered a computer readable storage medium, for example, or a tangible storage device.

Moreover, a step or block that represents one or more information transmissions can correspond to information transmissions between software and/or hardware modules in the same physical device. However, other information transmissions can be between software modules and/or hardware modules in different physical devices.

The particular arrangements shown in the figures should not be viewed as limiting. It should be understood that other embodiments can include more or less of each element shown in a given figure. Further, some of the illustrated elements can be combined or omitted. Yet further, an example embodiment can include elements that are not illustrated in the figures.

While various aspects and embodiments have been disclosed herein, other aspects and embodiments will be apparent to those skilled in the art. The various aspects and embodiments disclosed herein are for purpose of illustration and are not intended to be limiting, with the true scope being indicated by the following claims.

What is claimed is:

1. A system for adapting audio notifications associated with events in a managed network of a computational instance of a remote network management platform, wherein the system is disposed within the computational instance, the system comprising:

a database configured for storing speech-characteristics parameters for mapping event characteristics to speech characteristics, wherein the database comprises records, and wherein each record is associated with a respective user, and includes user-specific parameters for mapping event characteristics to speech characteristics, the user-specific parameters being customizable according to the respective user, and the speech characteristics including at least one of volume, pitch, tone, or speed; and one or more server devices disposed within the remote network management platform, wherein the one or more server devices are configured to:

receive, from a computing device communicatively connected with the managed network, a message indicating an occurrence of a network event;

process the message to designate a particular user for notification of the network event, and to determine (i) a text message associated with the network event, and (ii) specific event characteristics of the network event, wherein the specific event characteristics comprise event type, event severity, and event priority;

determine specific speech characteristics for an audio recording of synthesized speech of the text message by at least mapping the specific event characteristics to the user-specific parameters of the particular user;

generate the audio recording of synthesized speech of the text message according to the determined specific speech characteristics using a text-to-speech engine; and transmit the audio recording to a client device associated with the particular user for playout by the client device according to the specific speech characteristics.

2. The system of claim 1, wherein the one or more server devices are further configured to:

designate a different user for notification of the network event;

determine different specific speech characteristics for a different audio recording of different synthesized speech of the text message by mapping the specific event characteristics to the user-specific parameters of the different user;

generate the different audio recording of the different synthesized speech of the text message according to the determined different specific speech characteristics using the text-to-speech engine; and transmit the different audio recording to a different client device associated with the different user for playout by the different client device according to the different specific speech characteristics.

3. The system of claim 1, wherein at least one of the user-specific parameters specifies a value for a corresponding at least one of the speech characteristics, and wherein mapping the specific event characteristics to the user-specific parameters of the particular user comprises selecting a particular value for the corresponding at least one speech characteristic based on at least one of the specific event characteristics.

4. The system of claim 1, wherein at least one of the user-specific parameters specifies a value range between a minimum and a maximum for a corresponding at least one of the speech characteristics, and wherein mapping the specific event characteristics to the user-specific parameters of the particular user comprises selecting a value between the minimum and maximum for the corresponding at least one speech characteristic based on at least one of the specific event characteristics.

5. The system of claim 1, wherein the one or more server devices are further configured to determine one or more real-time physical environment properties of the client device, wherein the specific speech characteristics include environment-based audio properties for adapting playout of the audio recording according to the determined one or more real-time physical environment properties of the client device, and wherein determining the specific speech characteristics for the audio recording of synthesized speech of the text message further comprises determining the environment-based audio properties based on at least one of the one or more physical environment properties of the client device.

6. The system of claim 5, wherein the one or more real-time physical environment properties of the client device are at least one of: device audio capabilities, device audio settings status, geographic location, motion, velocity, or ambient noise level, and wherein the environment-based audio properties are at least one of: (i) an audio property not already determined by mapping the specific event characteristics to the user-specific parameters of the particular user, or (ii) a modification of a specific speech characteristic already determined by mapping the specific event characteristics to the user-specific parameters of the particular user, the modification being based on at least one of the one or more physical environment properties of the client device.

7. The system of claim 1, wherein the one or more server devices are further configured to receive, via a user interface, interactive user data for customizing the user-specific parameters of any given one of the database records.

8. The system of claim 7, wherein the user-specific parameters of each record include: (i) one or more user-settable permissions for the system to monitor one or more corresponding physical environment properties of a respective client device associated with the respective user, and (ii) an environment parameter associated with each of the one or more user-settable permissions, and wherein the one or more server devices are further configured to:

determine from real-time monitoring one or more current physical environment properties of the client device associated with the particular user, if the user-settable permissions of the particular user grant permission for the system to monitor the one or more current physical environment properties; and for at least one user-settable permission for which permission has been granted, update the associated environment parameter according to the real-time monitoring.

9. The system of claim 8, wherein determining the specific speech characteristics for the audio recording of the synthesized speech of the text message by at least mapping the specific event characteristics to the user specific parameters of the particular user comprises determining the specific speech characteristics based on both the user-specific parameters of the particular user as customized via the user interface, and any one or more environment parameters associated with a granted user-settable permission.

10. The system of claim 1, wherein the user-specific parameters of each record have default settings in the absence being customized according to the respective user.

11. A method for adapting audio notifications associated with events in a managed network of a computational instance of a remote network management platform, wherein a database disposed within the computational instance is configured for storing speech-characteristics parameters for mapping event characteristics to speech characteristics, wherein the database comprises records, and wherein each record is associated with a respective user, and includes user-specific parameters for mapping event characteristics to speech characteristics, the user-specific parameters being customizable according to the respective user, and the speech characteristics including at least one of volume, pitch, tone, or speed, and wherein the method comprises:

at a server device disposed within the remote network management platform, receiving, from a computing device communicatively connected with the managed network, a message indicating an occurrence of a network event;

at the server device, processing the message to designate a particular user for notification of the network event, and to determine (i) a text message associated with the network event, and (ii) specific event characteristics of the network event, wherein the specific event characteristics comprise event type, event severity, and event priority;

determining specific speech characteristics for an audio recording of synthesized speech of the text message by at least mapping the specific event characteristics to the user-specific parameters of the particular user;

generating the audio recording of synthesized speech of the text message according to the determined specific speech characteristics using a text-to-speech engine; and transmitting the audio recording to a client device associated with the particular user for playout by the client device according to the specific speech characteristics.

12. The method of claim 11, further comprising:

designating a different user for notification of the network event;

determining different specific speech characteristics for a different audio recording of different synthesized speech of the text message by mapping the specific event characteristics to the user specific parameters of the different user;

generating the different audio recording of the different synthesized speech of the text message according to the determined different specific speech characteristics using the text-to-speech engine; and transmitting the different audio recording to a different client device associated with the different user for playout by the different client device according to the different specific speech characteristics.

13. The method of claim 11, wherein the user-specific parameters specify at least one of (i) a value for a corresponding at least one of the speech characteristics, or (ii) a value range between a minimum and a maximum for a corresponding at least one of the speech characteristics, and wherein mapping the specific event characteristics to the user-specific parameters of the particular user comprises selecting at least one of (i) a particular value for the corresponding at least one speech characteristic based on at least one of the specific event characteristics, or (ii) a value between the minimum and maximum for the corresponding at least one speech characteristic based on at least one of the specific event characteristics.

14. The method of claim 11, wherein the method further comprises determining one or more real-time physical environment properties of the client device, wherein the specific speech characteristics include environment-based audio properties for adapting playout of the audio recording according to the determined one or more real-time physical environment properties of the client device, and wherein determining the specific speech characteristics for the audio recording of synthesized speech of the text message further comprises determining the environment-based audio properties based on at least one of the one or more physical environment properties of the client device.

15. The method of claim 14, wherein the one or more real-time physical environment properties of the client device are at least one of: device audio capabilities, device audio settings status, geographic location, motion, velocity, or ambient noise level, and wherein the environment-based audio properties are at least one of: (i) an audio property not already determined by mapping the specific event characteristics to the user specific parameters of the particular user, or (ii) a modification of a specific speech characteristic already determined by mapping the specific event characteristics to the user specific parameters of the particular user, the modification being based on at least one of the one or more physical environment properties of the client device.

16. The method of claim 11, wherein the method further comprises receiving, via a user interface, interactive user data for customizing the user-specific parameters of any given one of the database records.

17. The method of claim 16, wherein the user-specific parameters of each record include: (i) one or more user-settable permissions to monitor one or more corresponding physical environment properties of a respective client device associated with the respective user, and (ii) an environment parameter associated with each of the one or more user-settable permissions, and wherein the method further comprises:

determining from real-time monitoring one or more current physical environment properties of the client device associated with the particular user, if the user-settable permissions of the particular user grant permission to monitor the one or more current physical environment properties; and for at least one user-settable permission for which permission has been granted, updating the associated environment parameter according to the real-time monitoring.

18. The method of claim 17, wherein determining the specific speech characteristics for the audio recording of the synthesized speech of the text message by at least mapping the specific event characteristics to the user specific parameters of the particular user comprises determining the specific speech characteristics based on both the user-specific parameters of the particular user as customized via the user interface, and any one or more environment parameters associated with a granted user-settable permission.

19. The method of claim 11, wherein the user-specific parameters of each record have default settings in the absence being customized according to the respective user.

20. A non-transitory computer readable medium having instructions stored thereon for adapting audio notifications associated with events in a managed network of a computational instance of a remote network management platform, wherein a database disposed within the computational instance is configured for storing speech-characteristics parameters for mapping event characteristics to speech characteristics, wherein the database comprises records, and wherein each record is associated with a respective user, and includes user-specific parameters for mapping event characteristics to speech characteristics, the user-specific parameters being customizable according to the respective user, and the speech characteristics including at least one of volume, pitch, tone, or speed, and wherein the instructions, when executed by one or more processors of a server device disposed within the remote network management platform, cause the server device to carry out operations including:

receiving, from a computing device communicatively connected with the managed network, a message indicating an occurrence of a network event;

processing the message to designate a particular user for notification of the network event, and to determine (i) a text message associated with the network event, and (ii) specific event characteristics of the network event, wherein the specific event characteristics comprise event type, event severity, and event priority;

determining specific speech characteristics for an audio recording of synthesized speech of the text message by at least mapping the specific event characteristics to the user specific parameters of the particular user;

generating the audio recording of synthesized speech of the text message according to the determined specific speech characteristics using a text-to-speech engine; and transmitting the audio recording to a client device associated with the particular user for playout by the client device according to the specific speech characteristics.

* * * * *